US010595108B2

(12) United States Patent
Kim et al.

(10) Patent No.: US 10,595,108 B2
(45) Date of Patent: Mar. 17, 2020

(54) SPEAKER APPARATUS AND ELECTRONIC APPARATUS INCLUDING SAME

(71) Applicant: SAMSUNG ELECTRONICS CO., LTD., Suwon-si (KR)

(72) Inventors: Sung-joo Kim, Suwon-si (KR); Jong-bae Kim, Seoul (KR); Sung-ha Son, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/158,744

(22) Filed: May 19, 2016

(65) Prior Publication Data

US 2017/0026726 A1 Jan. 26, 2017

(30) Foreign Application Priority Data

Jul. 24, 2015 (KR) ..... 10-2015-0105074

(51) Int. Cl.
*H04R 1/02* (2006.01)
*H04R 1/28* (2006.01)
(Continued)

(52) U.S. Cl.
CPC ..... *H04R 1/028* (2013.01); *H04R 1/023* (2013.01); *H04R 1/2803* (2013.01); *H04R 1/345* (2013.01);
(Continued)

(58) Field of Classification Search
CPC ..... H04R 1/028; H04R 1/025; H04R 9/06; H04R 1/023; H04R 19/02; H04R 2499/15;
(Continued)

(56) References Cited

U.S. PATENT DOCUMENTS 3,636,278 A * 1/1972 Heil ..... H04R 7/14 381/163
4,544,805 A * 10/1985 Sawafuji ..... H04R 9/063 181/173
(Continued)

FOREIGN PATENT DOCUMENTS

CN 102868959 A 1/2013
CN 103124387 A 5/2013
(Continued)

OTHER PUBLICATIONS

Communication dated Aug. 19, 2016, issued by the International Searching Authority in counterpart International Application No. PCT/KR2016/005189 (PCT/ISA/210 & PCT/ISA/237).
(Continued)

*Primary Examiner* — Fan S Tsang
*Assistant Examiner* — Angelica M McKinney
(74) *Attorney, Agent, or Firm* — Sughrue Mion, PLLC

(57) ABSTRACT

A speaker apparatus includes a speaker unit including a magnet configured to provide a magnetic field; and a membrane disposed in the magnet field, configured to be vibratable in a first direction, and configured to emit a sound in a second direction perpendicular to the first direction; and a blocking unit disposed at the membrane, configured to block a first region of the membrane having a first height along the first direction from being exposed and configured to expose a second region of the membrane having a second height, a sum of the first and the second heights corresponds to a total height of the membrane, wherein the first height of the membrane blocked by the blocking unit is less than a half of a wavelength corresponding to a maximum frequency in a frequency dory range of the sound emitted from the membrane.

26 Claims, 28 Drawing Sheets

(51) Int. Cl.
*H04R 7/14* (2006.01)
*H04R 1/34* (2006.01)
*H04R 9/06* (2006.01)

(52) U.S. Cl.
CPC ..... *H04R 7/14* (2013.01); *H04R 9/06* (2013.01); *H04R 2499/11* (2013.01); *H04R 2499/15* (2013.01)

(58) Field of Classification Search
CPC ..... H04R 7/14; H04R 1/323; H04R 1/345; H04R 1/2803
See application file for complete search history.

(56) References Cited

U.S. PATENT DOCUMENTS

| | | | | |
|---|---|---|---|---|
| 4,939,784 | A * | 7/1990 | Bruney | H04R 7/10 181/170 |
| 8,208,678 | B2 | 6/2012 | Mundorf | |
| 8,650,073 | B2 * | 2/2014 | Littman | G06Q 30/0261 705/14.1 |
| 9,281,763 | B2 * | 3/2016 | Gutierrez | H02N 1/006 |
| 2003/0068063 | A1 * | 4/2003 | Usuki | H04R 9/10 381/396 |
| 2004/0008863 | A1 | 1/2004 | Hutt et al. | |
| 2008/0265709 | A1 * | 10/2008 | Clausen | H01L 41/083 310/300 |
| 2009/0323996 | A1 * | 12/2009 | Danley | H04R 1/345 381/340 |
| 2010/0098271 | A1 * | 4/2010 | Mundorf | H04R 1/323 381/162 |
| 2011/0320278 | A1 * | 12/2011 | Littman | G06Q 30/0261 705/14.58 |
| 2012/0114136 | A1 * | 5/2012 | Horigome | H04R 9/02 381/86 |
| 2014/0029779 | A1 | 1/2014 | Yamauchi et al. | |
| 2014/0247955 | A1 * | 9/2014 | Nystrom | H04R 19/02 381/150 |
| 2017/0013366 | A1 * | 1/2017 | Lee | H04R 9/063 |

FOREIGN PATENT DOCUMENTS

| | | | | |
|---|---|---|---|---|
| DE | 20207154 | U1 | | 9/2002 |
| EP | 2158789 | B1 | | 10/2010 |
| JP | 200480636 | A | | 3/2004 |
| JP | 2008124676 | A | * | 5/2008 |
| JP | 2008124676 | A | * | 5/2008 |
| JP | 2008124676 | | * | 6/2008 |
| JP | 2010258495 | A | | 11/2010 |
| JP | 2012244314 | A | | 12/2012 |
| KR | 20080038542 | A | * | 5/2008 |
| KR | 1020080038542 | A | | 5/2008 |
| KR | 101116572 | B1 | | 2/2012 |
| WO | 2013169745 | A1 | | 11/2013 |

OTHER PUBLICATIONS

Communication dated Jul. 12, 2018, from the European Patent Office in counterpart European Application No. 16830678.5.
Communication dated Sep. 4, 2019 issued by the State Intellectual Property Office of P.R. China in counterpart Chinese Application No. 201680049141.X.

* cited by examiner

SPEAKER APPARATUS AND ELECTRONIC APPARATUS INCLUDING SAME

CROSS-REFERENCE TO RELATED APPLICATION

This application claims priority from Korean Patent Application No. 10-2015-0105074, filed on Jul. 24, 2015, in the Korean Intellectual Property Office, the disclosure of which is incorporated herein by reference in its entirety.

BACKGROUND

1. Field

Apparatuses consistent with exemplary embodiments relate to a speaker apparatus and an electronic apparatus including the same.

2. Description of the Related Art

Along with the recent development of flat display panel technology, electronic apparatuses such as digital televisions (DTVs) have slim design. A speaker apparatus for outputting a sound, which is installed in the electronic apparatuses, has also been demanded to have an appropriate shape and thickness to fit in the slim electronic apparatuses.

For example, an electronic apparatus may include a small opening in a thin slit shape opened in a front direction in which a viewer or an audience is located, and a speaker apparatus outputs or emits a sound through the small opening.

A speaker unit of the speaker apparatus is required to have a certain size in order to have a sound pressure of a certain level or more. The size of the speaker unit may be larger than a size of the opening provided on the electronic apparatus. In this case, a portion of the speaker unit is hidden so as not to be viewed from the front.

As such, when a sound from one portion of the speaker unit is output through the opening while the other portion of the speaker unit is hidden behind the opening, deterioration of sound quality becomes a problem.

SUMMARY

One or more exemplary embodiments provide a speaker apparatus capable of providing wide horizontal directivity while outputting a sound in a high-frequency range, which has a sound pressure of a certain level or more, and an electronic apparatus including the same.

Additional aspects will be set forth in part in the description which follows and, in part, will be apparent from the description, or may be learned by practice of the presented exemplary embodiments.

According to an aspect of an exemplary embodiment, a speaker apparatus includes: a speaker unit including a magnet configured to provide a magnetic field and a membrane disposed in the magnet field and configured to be vibratable in a first direction and emit a sound in a front direction that is one direction of a second direction perpendicular to the first direction; and a blocking unit disposed in the front direction of the membrane and configured to block a region corresponding to a partial height of the total height of the membrane in the first direction from being exposed to the front direction and expose a region corresponding to the remaining height of the total height of the membrane to the front direction, wherein the first direction is an up-down direction perpendicular to a floor, a width of the membrane in a third direction that is perpendicular to the first and second directions is greater than the height of the membrane in the first direction, and the height of the membrane blocked by the blocking unit is less than a half of a wavelength corresponding to a maximum frequency in a frequency range of the sound emitted from the membrane.

The membrane may have a meandering shape along the first direction and vibrate while facing regions facing each other are moving in opposite directions along the first direction.

The frequency range of the sound emitted from the membrane may satisfy a sound pressure level that is equal to or greater than a sound pressure level lower by 6 dB than a mean sound pressure level of the sound emitted from the membrane.

The maximum frequency may be about 20 KHz, and the half of the wavelength corresponding to the maximum frequency may be about 8.5 mm.

The height of the membrane exposed to the front direction by the blocking unit may be about 5 mm or less.

The total height of the membrane may be less than about 13.5 mm.

The speaker apparatus may further include an enclosure configured to accommodate the speaker unit, wherein the total height of the enclosure in the first direction is less than about 16.5 mm.

A width of the membrane in the third direction may be less than about 42 mm.

A sound-absorption member may be disposed on at least one of both end portions of the membrane in the third direction.

The membrane may include facing regions facing each other in the first direction and a connection region disposed between the facing regions to connect the facing regions, the connection region may include a ridge region disposed in the front direction and a valley region disposed in a rear direction, and the sound-absorption member may be disposed in a certain space defined by the facing regions and the valley region.

The blocking unit may be further configured to expose a region corresponding to a partial width of the total width of the membrane in the third direction to the front direction and block a region corresponding to the remaining width of the total width of the membrane from being exposed to the front direction.

The width of the membrane exposed by the blocking unit may be about 25 mm or less.

The width of the membrane blocked from being exposed to the front direction by the blocking unit may be less than the half of the wavelength corresponding to the maximum frequency of a sound emitted from the membrane.

A sound-absorption member may be disposed in a region in which the membrane is blocked from being exposed to the front direction by the blocking unit.

The blocking unit may include a front grill disposed in the front direction of the membrane and a display unit disposed in the front direction of the front grill.

A region corresponding to the partial height of the total height of the membrane in the first direction may be blocked from being exposed to the front direction by at least one of the display unit and the front grill.

A region corresponding to the partial width of the total width of the membrane in the third direction may be blocked from being exposed to the front direction by at least one of the display unit and the front grill.

According to an aspect of another exemplary embodiment, a speaker apparatus includes: a speaker unit including a magnet configured to provide a magnetic field and a membrane disposed in the magnet field and configured to be vibratable in an up-down direction and emit a sound to a front direction that is one direction of a front-rear direction and having a width in a left-right direction which is greater than a height in the up-down direction; and a sound-absorption member disposed on at least one of both end portions of the membrane in the left-right direction and configured to absorb a portion of the sound emitted from the membrane.

The speaker apparatus may further include a blocking unit disposed in the front direction of the membrane and configured to expose a region corresponding to a partial width of the total width of the membrane in the left-right direction and block a region corresponding to the remaining width of the total width of the membrane from being exposed to the front direction, wherein the width of the membrane blocked from being exposed to the front direction by the block unit is less than a half of a wavelength corresponding to a maximum frequency in a frequency range of the sound emitted from the membrane.

According to an aspect of another exemplary embodiment, an electronic apparatus includes the speaker apparatus.

According to an aspect of another exemplary embodiment, a speaker apparatus includes a speaker unit including: a magnet configured to provide a magnetic field; and a membrane disposed in the magnet field, configured to be vibratable in a first direction, and configured to emit a sound in a second direction perpendicular to the first direction; and a blocking unit disposed at the membrane, configured to block a first region of the membrane having a first height along the first direction from being exposed and configured to expose a second region of the membrane having a second height, a sum of the first and the second heights corresponds to a total height of the membrane, wherein the first height of the membrane blocked by the blocking unit is less than a half of a wavelength corresponding to a maximum frequency in a frequency range of the sound emitted from the membrane.

A width of the membrane extending in a third direction, which is perpendicular to the first and the second directions, may be greater than the total height of the membrane in the first direction.

The membrane may have a meandering shape along the first direction and vibrates while adjacent facing regions of the membrane facing each other move in opposite directions of each other along the first direction.

The frequency range of the sound emitted from the membrane may satisfy a sound pressure level that is equal to or greater than a sound pressure level lower by 6 dB than an average sound pressure level of the sound emitted from the membrane.

The maximum frequency may be about 20 KHz, and the half of the wavelength corresponding to the maximum frequency of 20 KHz may be about 8.5 mm.

The second height of the membrane may be about 5 mm or less.

The total height of the membrane may be less than about 13.5 mm.

The speaker apparatus may further include an enclosure configured to accommodate the speaker unit, wherein a height of the enclosure in the first direction is less than about 16.5 mm.

The width of the membrane in the third direction may be less than about 42 mm.

The speaker apparatus may further include a sound-absorption member provided on at least one of opposite end portions of the membrane along the third direction.

The membrane may include: adjacent facing regions facing each other along the first direction; and a connection region disposed between the adjacent facing regions to connect the adjacent facing regions, wherein the connection region includes a ridge region disposed on a first side of the membrane along the second direction and a valley region disposed on a second side opposite to the first side of the membrane along the second direction, and wherein the sound-absorption member is disposed in a space defined by the adjacent facing regions and the valley region.

The blocking unit may be configured to expose the second region having a second width of the membrane in a third direction perpendicular to the first and the second directions and configured to block the first region having a first width of the membrane from being exposed, a sum of the first and the second widths correspond to a total width of the membrane.

The second width of the membrane may be about 25 mm or less.

The first width of the membrane being blocked by the blocking unit is less than the half of the wavelength corresponding to the maximum frequency of the sound emitted from the membrane.

The speaker apparatus may further include a sound-absorption member disposed at the first region in which the membrane is blocked from being exposed by the blocking unit.

The blocking unit may include: a front grill disposed at the membrane; and a display unit disposed at the front grill.

The first region of the membrane having the first height may be blocked from being exposed by at least one of the display unit and the front grill.

The first region of the membrane having the first width may be blocked from being exposed by at least one of the display unit and the front grill.

According to an aspect of another exemplary embodiment, a speaker apparatus includes: a speaker unit including: a magnet configured to provide a magnetic field; and a membrane disposed in the magnet field, configured to be vibratable in a vertical direction and configured to emit a sound in a first horizontal direction perpendicular to the vertical direction, the membrane having a total width in a second horizontal direction which is greater than a height in the vertical direction, the second horizontal direction being perpendicular to the first horizontal direction and the vertical direction; and a sound-absorption member disposed on at least one of opposite end portions of the membrane along the second horizontal direction and configured to absorb a portion of the sound emitted from the membrane.

The speaker apparatus may further include a blocking unit disposed at the membrane, configured to expose a first region of the membrane having a first width in the second horizontal direction and configured to block a second region having a second width from being exposed along the first horizontal direction, a sum of the first and the second widths corresponding to the total width, wherein the second width of the membrane is less than a half of a wavelength corresponding to a maximum frequency in a frequency range of the sound emitted from the membrane.

According to an aspect of another exemplary embodiment, a speaker apparatus may include: a speaker unit including a membrane configured to be expanded and compressed in a first direction, and configured to emit a sound in a second direction perpendicular to the first direction by being expanded and compressed; and a blocking unit disposed at a first side of the membrane along the second direction and including: a first portion configured to block a first region of the membrane provided on the first side of the membrane and having a first height along the first direction; and a second portion configured to expose a second region of the membrane provided on the first side of the membrane and having a second height, wherein a sum of the first and the second heights of the membrane corresponds to a total height of the membrane, and wherein the first height of the membrane blocked by the blocking unit is less than a half of a wavelength corresponding to a maximum frequency in a frequency range of the sound emitted from the membrane.

A width of the membrane extending in a third direction, which is perpendicular to the first and the second directions, may be greater than the total height of the membrane in the first direction.

The second portion may include an acoustic guide tube.

BRIEF DESCRIPTION OF THE DRAWINGS

The above and/or other aspects of the disclosure will become apparent and more readily appreciated from the following description of the exemplary embodiments, taken in conjunction with the accompanying drawings in which.

DETAILED DESCRIPTION

Figure 1:
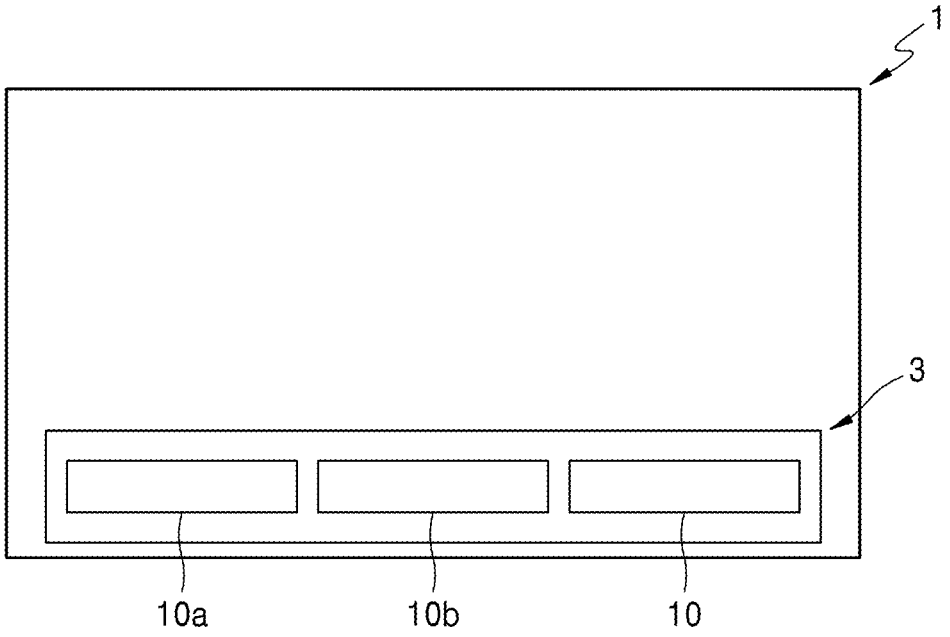
FIG. 1 illustrates a block diagram of an electronic apparatus according to an exemplary embodiment.

Hereinafter, configurations and applications of exemplary embodiments will be described in detail with reference to the accompanying drawings.

The terms used in the specification will be schematically described, and then, the disclosed exemplary embodiments will be described in detail.

The terms used in this specification are those general terms currently widely used in the art, but the terms may vary according to the intention of those of ordinary skill in the art, precedents, or new technology in the art. Also, specified terms may be selected by the applicant, and in this case, the detailed meaning thereof will be described in the detailed description. Thus, the terms used in the specification should be understood not as simple names but based on the meaning of the terms and the overall description.

Throughout the specification, it will also be understood that when a component "includes" an element, unless there is another opposite description thereto, it should be understood that the component does not exclude another element but may further include another element.

Although terms, such as 'first' and 'second', can be used to describe various elements, the elements cannot be limited by the terms. The terms can be used to classify a certain element from another element.

Reference will now be made in detail to exemplary embodiments, examples of which are illustrated in the accompanying drawings. In the drawings, parts irrelevant to the description are omitted to clearly describe the exemplary embodiments, and like reference numerals denote like elements throughout the specification. In this regard, the present exemplary embodiments may have different forms and should not be construed as being limited to the descriptions set forth herein. Accordingly, the exemplary embodiments are merely described below, by referring to the figures, to explain aspects. As used herein, expressions such as "at least one of," when preceding a list of elements, modify the entire list of elements and do not modify the individual elements of the list.

FIG. 1 illustrates a block diagram of an electronic apparatus 1 according to an exemplary embodiment.

Referring to FIG. 1, the electronic apparatus 1 includes at least one speaker apparatus 3 configured to output a sound to the outside of the electronic apparatus 1. The speaker apparatus 3 may emit a sound within an audible frequency range to the outside. For example, the audible frequency may be about 20 Hz to about 20 KHz.

According to the exemplary embodiment, the speaker apparatus 3 may output a sound in a three-way type including first, second, and third speaker units 10*a*, 10*b* and 10. The first, second, and third speaker units 10*a*, 10*b* and 10 may reproduce the sound by dividing the sound into a low-frequency range, an intermediate-frequency range, and a high-frequency range.

For example, the first speaker unit 10*a* may be configured to output a sound of the low-frequency range corresponding to about 20 Hz to about 300 Hz, the second speaker unit 10*b* may be configured to output a sound of the intermediate-frequency range corresponding to about 300 Hz to about 2 KHz, and the third speaker unit 10 may be configured to output a sound of the high-frequency range corresponding to about 2 KHz to about 20 KHz.

The frequency range of the sound emitted from each of the first, second, and third speaker units 10*a*, 10*b* and 10 may indicate a frequency range of a sound, e.g., an effective frequency range, which is intentionally used by each of the first, second, and third speaker units 10*a*, 10*b* and 10. For example, the frequency range of the sound emitted from each of the first, second, and third speaker units 10*a*, 10*b* and 10 may indicate a frequency range of a sound satisfying a sound pressure level that is equal to or greater than a sound pressure level lower by about 6 dB than an average sound pressure level of the sound emitted from the speaker apparatus 3. For example, when the average sound pressure level of the sound emitted from the third speaker unit 10 is about 70 dB, the frequency range of the sound emitted from the third speaker unit 10 may be a frequency range of a sound satisfying about 64 dB or more. Accordingly, even though the third speaker unit 10 is capable of actually outputting a sound of about 1 KHz to about 40 KHz, when the frequency range of the sound satisfying about 64 dB or more is about 2 KHz to about 20 KHz, the frequency range of the sound emitted from the third speaker unit 10 may be about 2 KHz to about 20 KHz.

Although it has been described in the exemplary embodiment that a sound of the speaker apparatus 3 is output in a three-way type, a configuration of the speaker apparatus 3 for an acoustic output is not limited thereto and may be varied. For example, the speaker apparatus 3 may reproduce a sound in a one-way type, a two-way type, or a four-way type.

Figure 2A:
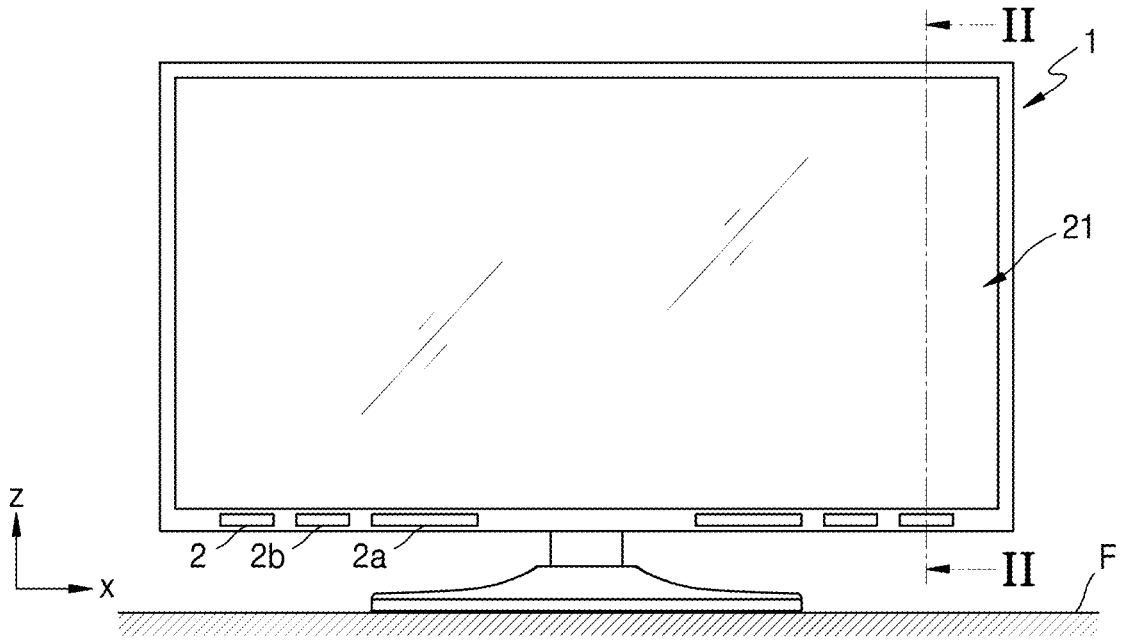
FIGS. 2A and 2B respectively illustrate a front view and a cross-sectional view of the electronic apparatus of FIG. 1.
Figure 2B:
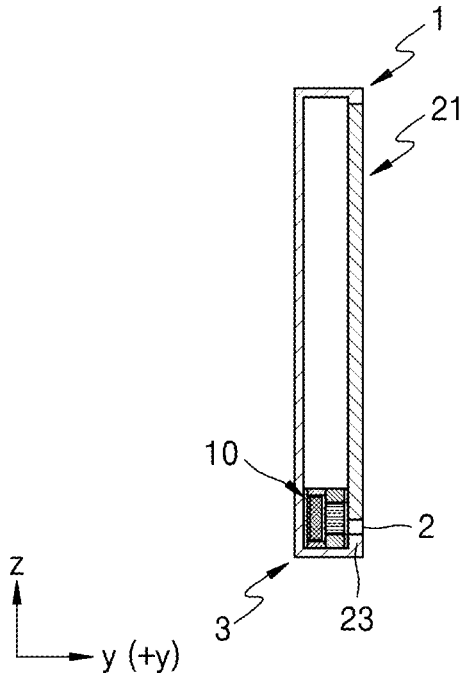

FIGS. 2A and 2B respectively illustrate a front view and a cross-sectional view of the electronic apparatus 1 of FIG. 1. FIG. 2B is a cross-sectional view taken along line II-II of FIG. 2A, and the other components except for the speaker apparatus 3 are omitted from or schematically shown in FIG. 2B.

Referring to FIGS. 1, 2A, and 2B, the electronic apparatus 1 according to the exemplary embodiment may include the at least one speaker apparatus 3 and first, second, and third acoustic output ports 2*a*, 2*b*, and 2 through which a sound emitted from the speaker apparatus 3 is released to the outside of the electronic apparatus 1.

The speaker apparatus 3 may output a sound in a stereoscopic type. For example, one pair of speaker apparatuses 3 may be arranged at the left side and the right side, respectively, of the electronic apparatus 1 and reproduce a sound. However, the acoustic output of the speaker apparatuses 3 is not limited thereto, and the speaker apparatus 3 may output a sound in a monotype.

Each of the pair of speaker apparatuses 3 may include the first, second, and third speaker units 10*a*, 10*b* and 10. The first, second, and third speaker units 10*a*, 10*b* and 10 may be disposed on the rear of the first, second, and third acoustic output ports 2*a*, 2*b*, and 2, respectively. Sounds of the low-frequency range, the intermediate-frequency range, and the high-frequency range may be emitted to the outside of the electronic apparatus 1 through the first, second, and third acoustic output ports 2*a*, 2*b*, and 2, respectively.

At least one of the first, second, and third acoustic output ports 2*a*, 2*b*, and 2 may be disposed on a front surface of the electronic apparatus 1. For example, the third acoustic output port 2 through which a sound of the high-frequency range is output may be disposed on the front surface of the electronic apparatus 1. Herein, the front surface of the electronic apparatus 1 may be defined as a surface of the electronic apparatus 1, which faces a user.

The third acoustic output port 2 may be disposed at a lower part of the front surface of the electronic apparatus 1. For example, the third acoustic output port 2 may be disposed at a left lower part and a right lower part of a display unit 21 of the electronic apparatus 1. However, the arrangement and the number of third acoustic output ports 2 are not limited thereto and may be modified according to design intent. For example, the third acoustic output port 2 may be disposed at an upper part of the display unit 21 or disposed at an upper part and a lower part of the display unit 21.

Sizes of the first, second, and third acoustic output ports 2*a*, 2*b*, and 2 may be designed to be small by taking into account slimness of the electronic apparatus 1. For example, each of the first, second, and third acoustic output ports 2*a*, 2*b*, and 2 may be designed such that a height in an up-down direction (z direction) is less than a width extending in a left-right direction (x direction) as shown in FIGS. 2A and 2B. A height (i.e., in z-direction) of each of the first, second, and third acoustic output ports 2*a*, 2*b*, and 2 may be about 5 mm or less, and a width (i.e., in x-direction) of each of the first, second, and third acoustic output ports 2*a*, 2*b*, and 2 may be greater than the height of each of the first, second, and third acoustic output ports 2*a*, 2*b*, and 2.

The width of each of the first, second, and third acoustic output ports 2*a*, 2*b*, and 2 may be designed differently from one another according to a frequency range and a sound pressure level of a sound output through each of the first, second, and third acoustic output ports 2*a*, 2*b*, and 2. For example, the width of the first acoustic output port 2*a* may be relatively large, and the width of the third acoustic output port 2 may be relatively small.

Sizes of the first, second, and third speaker units 10*a*, 10*b* and 10 may vary according to a requisite sound pressure level, and the requisite sound pressure level may vary according to a frequency range and a type of the electronic apparatus 1. For example, when the electronic apparatus 1 is a TV, and the third speaker unit 10 is responsible for the high-frequency range corresponding to about 2 KHz to about 20 KHz, the requisite sound pressure level may be about 70 dB or more.

As described above, when the requisite sound pressure level is determined, the sizes of the first, second, and third speaker units 10*a*, 10*b* and 10 may be designed to have at least a predetermined size which is greater than the sizes of the first, second, and third acoustic output ports 2*a*, 2*b*, and 2, respectively.

In the exemplary embodiment, because the sizes of the first, second, and third speaker units 10*a*, 10*b* and 10 are larger than the sizes of the first, second, and third acoustic output ports 2*a*, 2*b*, and 2, respectively, a portion of the first, second, and third speaker units 10*a*, 10*b* and 10 is hidden without being exposed to a front direction (+y direction) of the electronic apparatus 1. That is, the portion of the first, second, and third speaker units 10*a*, 10*b* and 10 of the speaker apparatus 3 is blocked from being exposed to the front direction (+y direction) as shown in FIG. 2B.

Because frequencies of sounds output from the first and second speaker units 10*a* and 10*b* are lower than a frequency of a sound output from the third speaker unit 10, even though the sounds output from the first and second speaker units 10*a* and 10*b* are respectively emitted through the small-sized first and second acoustic output ports 2*a* and 2*b*, the sounds are hardly distorted. However, because the third speaker unit 10 emits a sound in the high-frequency range, which has a relatively shorter wavelength than the sounds emitted from the first and second speaker units 10*a* and 10*b*, the sound from the third speaker unit 10 may be significantly distorted during the emission/release of the sound through the small-sized third acoustic output port 2, thereby deteriorating a frequency response characteristic and an impulse response characteristic of the sound from the third speaker unit 10.

The speaker apparatus 3 according to the exemplary embodiment may provide a structure capable of minimizing distortion of a sound of the high-frequency range even though the sound is emitted through a small-sized acoustic output port. This will be described below with reference to FIGS. 3A through 22C.

It has been described in the exemplary embodiment described above that the electronic apparatus 1 is a TV including the display unit 21. However, according to one or more exemplary embodiments, the electronic apparatus 1 is not limited thereto and may include different types of apparatuses including the speaker apparatus 3. Examples of the electronic apparatus 1 may include a personal computer (PC), a laptop computer, a mobile phone, a tablet PC, a navigation terminal, a smartphone, a personal digital assistant (PDA), a portable multimedia player (PMP), and a digital broadcast receiver.

Figure 3A:
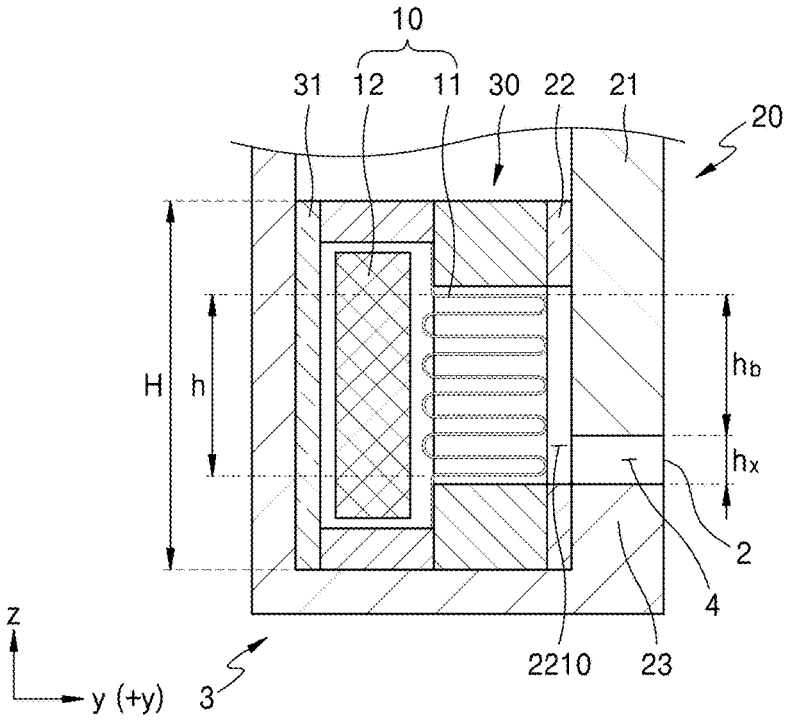
FIG. 3A illustrates a magnified cross-sectional view of a portion of the electronic apparatus of FIG. 1.
Figure 3B:
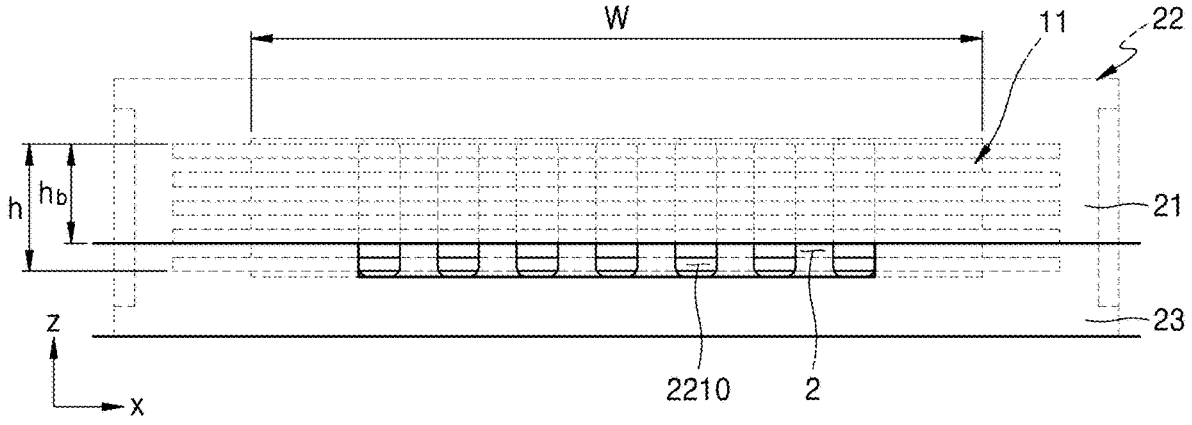
FIG. 3B illustrates a magnified front view of the electronic apparatus of FIG. 1.
Figure 4A:
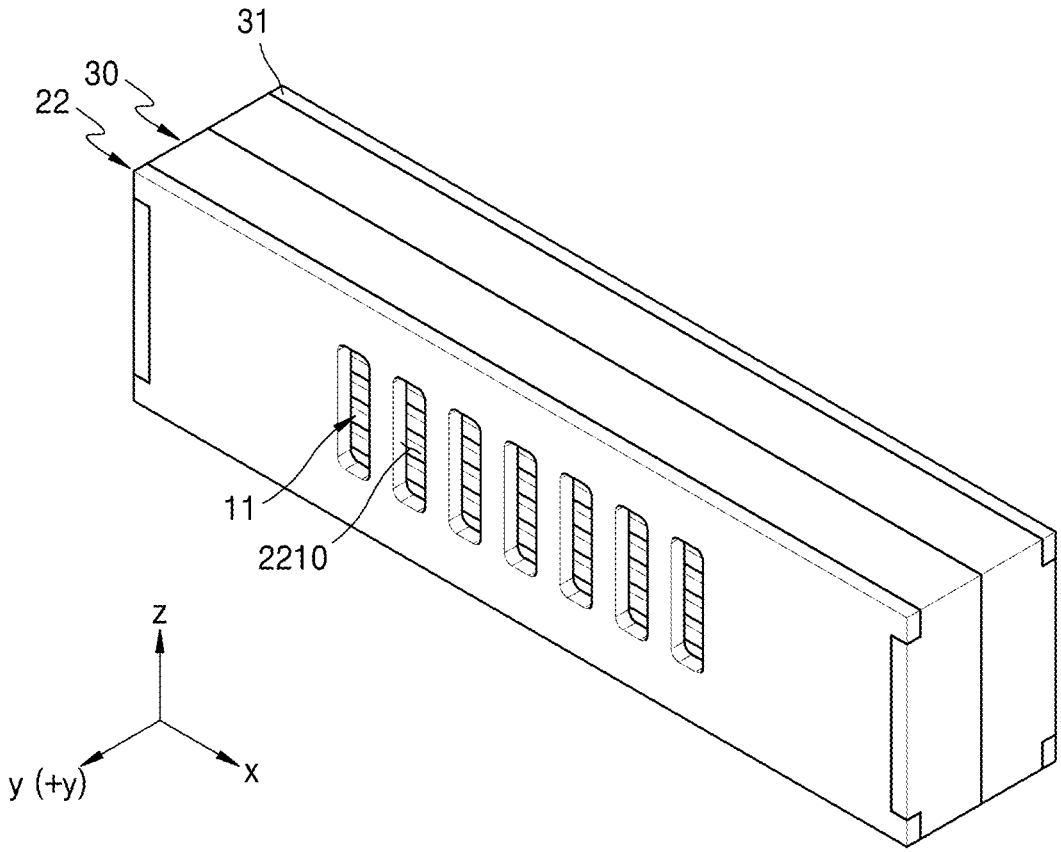
FIGS. 4A and 4B respectively illustrate an assembled perspective view and an exploded perspective view of a speaker apparatus except for a display unit.
Figure 4B:
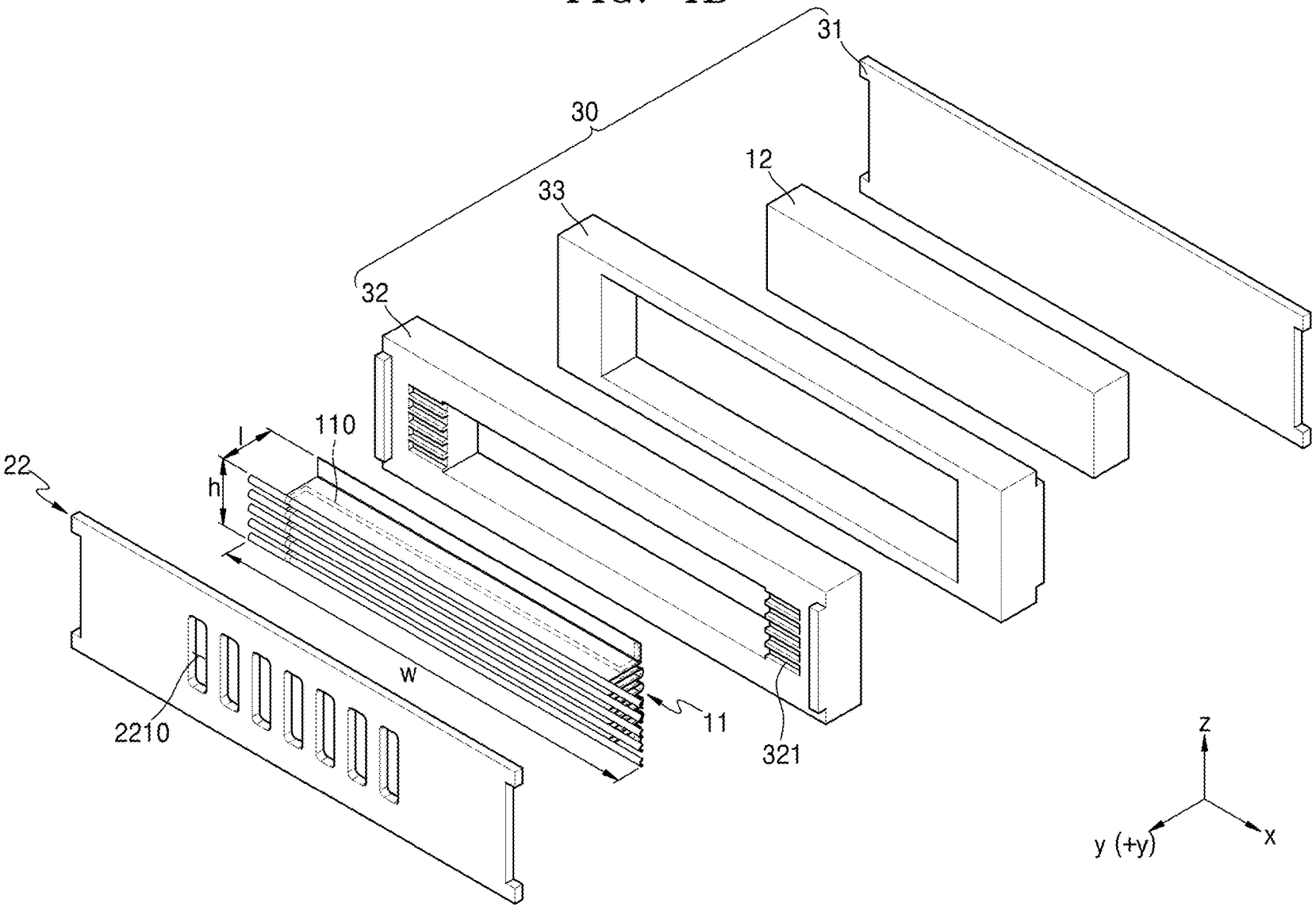

FIG. 3A illustrates a magnified cross-sectional view of a portion of the electronic apparatus 1 of FIG. 1, and FIG. 3B illustrates a magnified front view of a portion of the electronic apparatus 1 of FIG. 1. FIGS. 4A and 4B respectively illustrate an assembled perspective view and an exploded perspective view of the speaker apparatus 3 except for the display unit 21.

Referring to FIGS. 3A through 4B, the speaker apparatus 3 may include the third speaker unit 10 (hereinafter, referred to as "speaker unit 10") and a blocking unit 20. The blocking unit 20 is disposed in the front direction (+y direction) of the speaker unit 10 and blocks a portion of the speaker unit 10 from being exposed to the front direction (+y direction). The speaker apparatus 3 may further include an enclosure 30 configured to accommodate the speaker unit 10 therein.

The enclosure 30 includes an upper block 32 configured to support a membrane 11, a lower block 33 configured to accommodate a magnet 12, and a rear case 31 disposed on the rear of the magnet 12.

The speaker unit 10 includes the magnet 12 configured to provide a magnetic field B (see FIG. 5) and the membrane 11 disposed inside the magnetic field B. The membrane 11 and the magnet 12 are disposed inside the enclosure 30.

The enclosure 30 may support end portions of the membrane 11 in first (z-direction) and second (y-direction) directions. For example, both the end portions of the membrane 11 may be supported in the second direction by a groove 321 disposed in the front surface facing +y direction of the upper block 32 of the enclosure 30, and both the end portions of the membrane 11 may be supported in the first direction by the bottom surface of the groove 321 provided in the upper block 32.

The magnet 12 provides the magnetic field B to the membrane 11. The magnet 12 may be a permanent magnet. However, a type of the magnet 12 is not limited thereto and may be modified according to design intent. For example, the magnet 12 may be an electromagnet.

The magnet 12 may be disposed at the rear of the membrane 11 (−y direction). However, the position of the magnet 12 may be freely modified within a range of providing the magnetic field B to the membrane 11. For example, a plurality of magnets 12 may be arranged at a left side and a right side (along the +x and −x direction) of the membrane 11. The magnetic field B provided by the magnet 12 may have a direction of penetrating through the membrane 11.

The magnet 12 is disposed inside the enclosure 30. A front grill 22 may be disposed at the front (+y direction) of the enclosure 30. The rear case 31 of the enclosure 30 and the front grill 22 may include a ferromagnetic material. An example of the ferromagnetic substance is a cold rolled steel sheet. The magnetic field B provided to the membrane 11 may be concentrated by the rear case 31 of the enclosure 30 and the front grill 22 which include the ferromagnetic material.

A conductive member 110 through which a current flows may be disposed in the membrane 11. The conductive member 110 may be disposed in a direction that is perpendicular to the direction of the magnetic field B. When a current flows through the conductive member 110, the conductive member 110 may apply a force in a direction determined by the direction of the current and the direction of the magnetic field B, thereby making the membrane 11 vibrate. Although FIG. 4B shows the conductive member 110 arranged in a line inside the membrane 11, the arrangement of the conductive member 110 is not limited thereto, and the conductive member 110 may be arranged in two or more lines.

The speaker unit 10 may reproduce a sound in an air motion transformer (AMT) type. In the membrane 11, a vibrating direction may differ from an outputting (or emitting) direction. For example, the membrane 11 may vibrate in the first direction and output a sound in one direction of the second direction that is perpendicular to the first direction.

Figure 5:
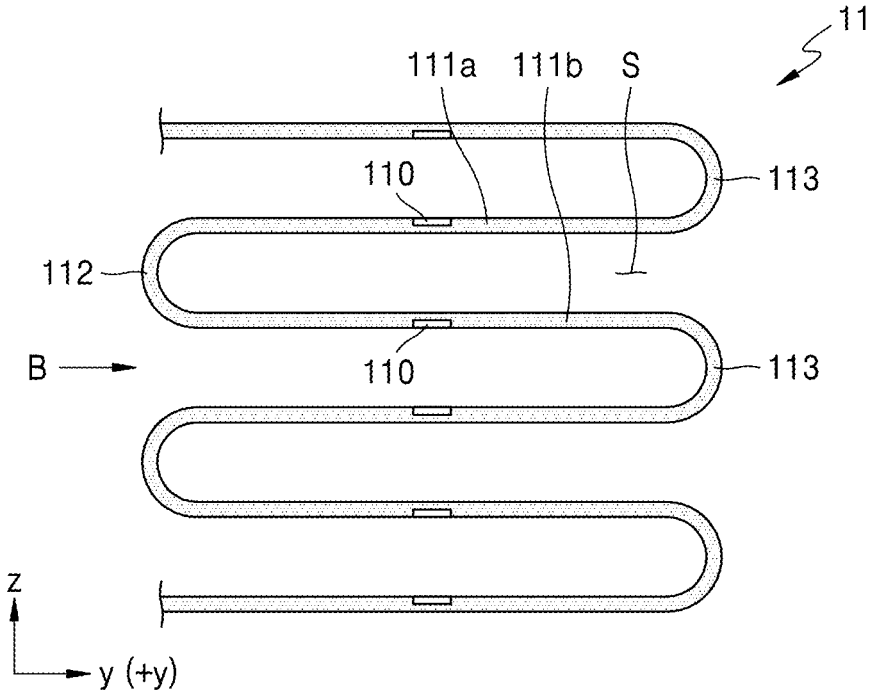
FIGS. 5, 6A, and 6B conceptually illustrate an operation of a membrane according to an air motion transformer (AMT) type.
Figure 6A:
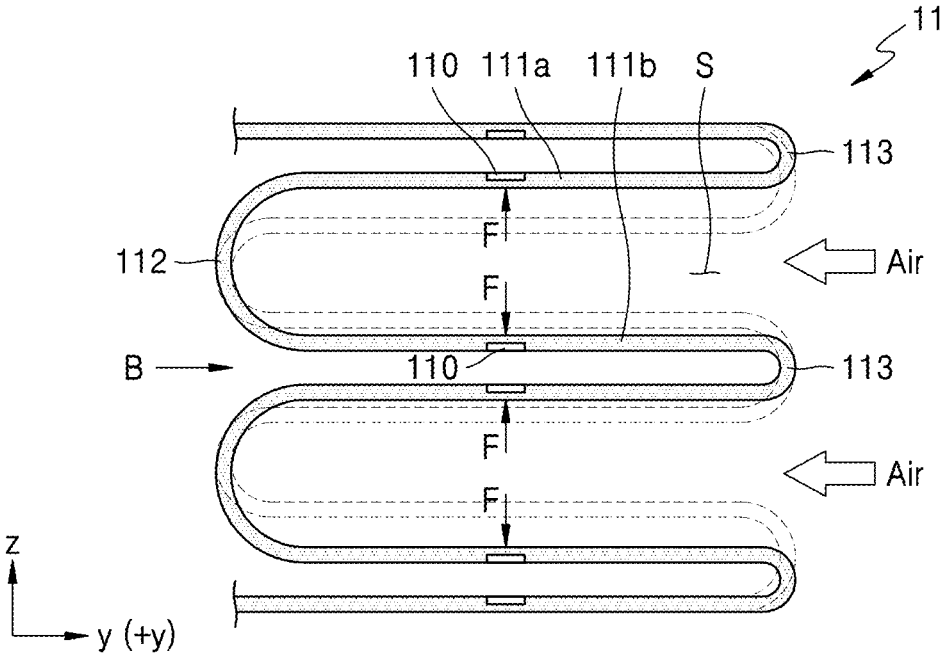
Figure 6B:
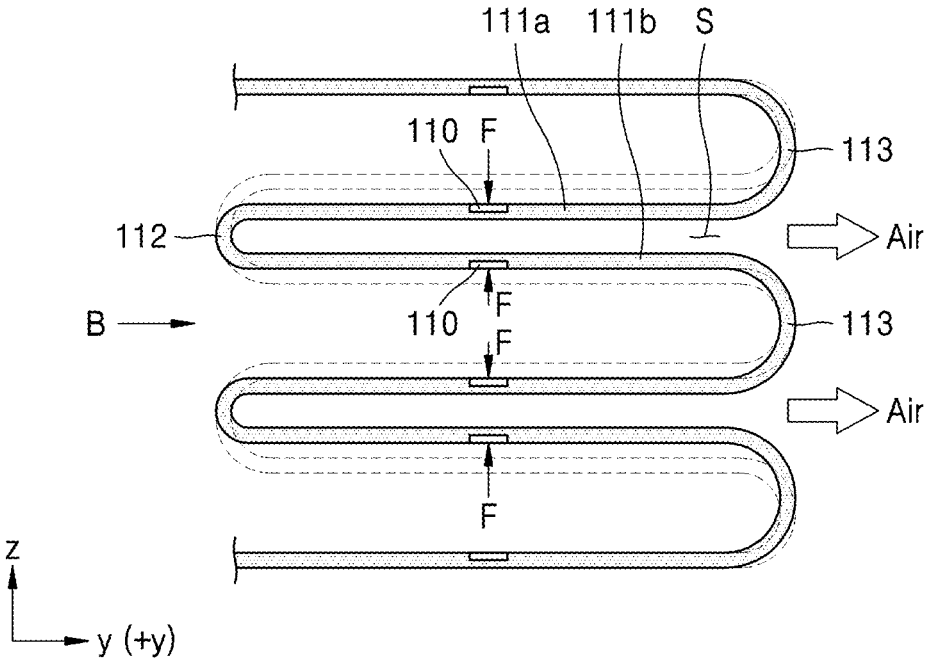

FIGS. 5, 6A, and 6B conceptually illustrate an operation of the membrane 11 according to the AMT type.

Referring to FIG. 5, the membrane 11 has a meandering/winding shape along the first direction (z-direction). The membrane 11 includes facing regions 111*a* and 111*b* facing each other in the first direction (z-direction) and a connection region connecting the facing regions 111*a* and 111*b*.

The magnetic field B provided by the magnet 12 (see FIG. 3A) penetrates through the membrane 11 in the second direction (y-direction). The direction of the magnetic field B provided by the magnet 12 is constantly maintained. A current may flow in opposite directions through conductive members 110 respectively disposed in the adjacent facing regions 111*a* and 111*b*. Accordingly, the adjacent facing regions 111*a* and 111*b* move in opposite directions along the first direction (z-direction). For example, the adjacent facing regions 111*a* and 111*b* move in directions of getting farther from or closer to each other along the first direction (z-direction). That is, the membrane 11 may expand and compress to generate a sound.

The connection region includes a ridge region 113 disposed in the front direction (+y direction) of the facing regions 111*a* and 111*b* and a valley region 112 disposed in the rear direction of the facing regions 111*a* and 111*b*. A predetermined space S of which the front direction is opened is defined by the facing regions 111*a* and 111*b* facing each other and the valley region 112.

Because the front direction of the space S is opened, when the adjacent facing regions 111*a* and 111*b* of the membrane 11 periodically move/vibrate along the first direction (z-direction), the adjacent facing regions 111*a* and 111*b* may periodically push air to the front direction (+y direction) through the space S.

Referring to FIG. 6A, a current may flow through the facing region 111*a* disposed at an upper part in a direction (+x direction) perpendicular to the first and the second direction (y and z directions), and a current may flow through the facing region 111*b* disposed at a lower part in a direction (−x direction) perpendicular to the first and the second direction (y and z directions). Accordingly, the adjacent facing regions 111*a* and 111*b* disposed in the up-down direction (z direction) move in a direction of getting farther from each other, and air is introduced into the space S.

Referring to FIG. 6B, a current may flow through the facing region 111*a* disposed at the upper part in the direction (−x direction) perpendicular to the first and the second direction (y and z directions), and a current may flow through the facing region 111*b* disposed at the lower part in the direction (+x direction) perpendicular to the first and the second direction (y and z directions). Accordingly, the adjacent facing regions 111*a* and 111*b* disposed in the up-down direction (z direction) move in a direction of getting closer to each other, and air is discharged through the space S.

Along with a change of a direction of a current flowing through the conductive member 110, a process of introducing or discharging air into or from the certain space S defined by the membrane 11 is repeated. Accordingly, a sound is output or emitted to the second direction (+y direction) due to vibrations of the membrane 11 in the first direction (z-direction).

Referring back to FIGS. 3A through 4B, the first direction may be the up-down direction (z direction) that is perpendicular to a floor F (see FIG. 2A). The membrane 11 may have a shape of meandering/winding in the up-down direction (z direction) and have a predetermined width in a third direction (+/−x direction) that is perpendicular to the first (+/−z-direction) and second (+/−y-direction) directions. The third direction may be the left-right direction (+/−x direction). For example, a width W of the membrane in the third direction may be less than about 42 mm.

As described above, the membrane 11 having a shape of meandering/winding along the up-down direction (z direction) may have a height h in the up-down direction (z direction) (hereinafter, referred to as "height h"), the width W in left-right direction (x direction) (hereinafter, referred to as "width W"), and a length l in the front-rear direction (y direction). Herein, the height h and the width W of the membrane 11 are defined as a height and a width excluding regions which are supported by the enclosure 30.

A magnitude of a sound emitted from the membrane 11, e.g., a sound pressure, may be related to the height h, the width W, and the length l of the membrane 11. For example, a sound pressure level of a sound emitted from the membrane 11 may be related to the height h and the width W of the membrane 11. The height h and the width W of the membrane 11 may be related to a height and a width of the space S defined by the facing region 111 and the valley region 112 inside the membrane 11.

The height h of the membrane 11 may be less than the width W of membrane 11. In other words, the width W of membrane 11 may be greater than the height h of the membrane 11. For example, when the height h of the membrane 11 is less than about 13.5 mm, the width W of membrane 11 may be greater than 13.5 mm and less than about 42 mm. The width W of membrane 11 may be greater by two times or more than the height h of the membrane 11.

As described above, by the structure in which the height h of the membrane 11 is less than the width W of membrane 11, the membrane 11 may reproduce a sound having a sound pressure having a required magnitude or more with a small height.

The height h of the membrane 11 may be less than a sum of a half ($\lambda_{min}/2$) of a wavelength $\lambda_{min}$ corresponding to a maximum frequency $f_{max}$ (hereinafter, referred to as "minimum wavelength $\lambda_{min}$") in a frequency range of a sound emitted from the membrane 11 and a height $h_x$ of the third acoustic output port 2 ((hereinafter, referred to as "an acoustic output port 2").

The frequency range of the sound emitted from the membrane 11 may be a frequency range of a sound satisfying a sound pressure level that is equal to or greater than a sound pressure level lower by 6 dB than an average sound pressure level of the sound emitted from the membrane 11. For example, when the average sound pressure level of the sound emitted from the membrane 11 is about 70 dB, the frequency range of the sound emitted from the membrane 11 may be a frequency range of a sound satisfying about 64 dB or more. Accordingly, even though the membrane 11 is capable of actually outputting a sound of about 1 KHz to about 40 KHz, when the frequency range of the sound satisfying about 64 dB or more may be about 2 KHz to about 20 KHz. In the exemplary embodiment, the frequency range of the sound emitted from the membrane 11 may be about 2 KHz to about 20 KHz. In addition, the maximum frequency $f_{max}$ may be about 20 KHz, the minimum wavelength $\lambda_{min}$ may be about 17 mm, and the half of the minimum wavelength $\lambda_{min}$ may be about 8.5 mm. The height $h_x$ of the acoustic output port 2 may be about 5 mm or less. In the exemplary embodiment, the height h of the membrane 11 may be less than about 13.5 mm that is a sum of the half of the minimum wavelength $\lambda_{min}$ (8.5 mm) and the height $h_x$ (5 mm) of the acoustic output port 2. A height H of the enclosure 30 may be less than about 16.5 mm.

In the above-described exemplary embodiment, the minimum wavelength $\lambda_{min}$ was calculated based on when a propagation speed of a sound is about 340 m/s. Because the propagation speed of a sound varies according to an atmospheric pressure and a temperature, the minimum wavelength $\lambda_{min}$ may slightly vary depending on the atmospheric pressure and the temperature. For example, when the atmospheric pressure is about 1 atm and the temperature is within a range of about 0° C. to about 20° C., the minimum wavelength $\lambda_{min}$ may be about 16.6 mm to about 17.2 mm, and the half of the minimum wavelength $\lambda_{min}$ may be about 8.3 mm to about 8.6 mm.

The blocking unit 20 may be disposed at the front (+y direction) of the membrane 11. The acoustic output port 2 may be formed on the front surface of the electronic apparatus 1 by the blocking unit 20. The blocking unit 20 may be configured to block a portion of the membrane 11 from being exposed to the front direction (+y direction) and to expose the other portion thereof to the front direction (+y direction).

For example, the blocking unit 20 may block a region corresponding to a partial height $h_b$ of the total height h of the membrane 11 from being exposed to the front direction (+y direction) and expose a region corresponding to the remaining height $h_x$ of the total height h of the membrane 11 to the front direction (+y direction).

The blocking height $h_b$ of the membrane 11, which is blocked by the blocking unit 20, may be less than the half of the minimum wavelength $\lambda_{min}$ of a sound emitted from the membrane 11. For example, when the half of the minimum wavelength $\lambda_{min}$ of a sound emitted from the membrane 11 is about 8.5 mm, the blocking height $h_b$ of the membrane 11, which is blocked by the blocking unit 20, may be greater than about 0 mm and less than about 8.5 mm.

The blocking unit 20 may include the front grill 22 disposed at the front (+y direction) of the membrane 11 and the display unit 21 disposed at the front (+y direction) of the front grill 22. The blocking unit 20 may further include a case 23 of the electronic apparatus 1.

The front grill 22 may be disposed at the front (+y direction) of the enclosure 30 in which the speaker unit 10 is accommodated. A gap between the front grill 22 and the membrane 11 may be about 0.1 mm to about 0.5 mm.

The front grill 22 may include a ferromagnetic material capable of forming a magnetic circuit with the magnet 12. The front grill 22 may include a plurality of release ports 2210 through which a sound emitted from the membrane 11 passes. The plurality of release ports 2210 may be spaced apart from one another along the left-right direction (x direction) and extend in the up-down direction (z direction). However, the arrangement and shape of the plurality of release ports 2210 are not limited thereto and may be modified according to design intent. For example, although not shown, the plurality of release ports 2210 may be spaced apart from one another in the up-down direction (z direction) and extend in the left-right direction (x direction). A height of the plurality of release ports 2210 may be equal to or greater than the height h of the membrane 11.

The display unit 21 disposed at the front (+y direction) of the front grill 22 may block a portion of the plurality of release ports 2210 from being exposed to the front direction (+y direction). For example, the display unit 21 may block an upper region of the plurality of release ports 2210 from being exposed to the front direction (+y direction) by a height $h_b$ corresponding to less than the half of the minimum wavelength $\lambda_{min}$ of a sound emitted from the membrane 11. Due to the display unit 21, a portion of a sound emitted in the front direction (+y direction) of the membrane 11 may be blocked without being directly released in the front direction (+y direction) of the electronic apparatus 1.

A lower region of the plurality of release ports 2210 of the front grill 22 having a height $h_x$, which is not blocked by the display unit 21, is exposed to the front direction (+y direction). Accordingly, a sound emitted from the membrane 11 may be released through the acoustic output port 2 by passing through the plurality of release ports 2210 of the front grill 22 and an acoustic guide tube 4. The acoustic guide tube 4 and the acoustic output port 2 may be defined by the display unit 21 and the case 23.

Figure 7A:
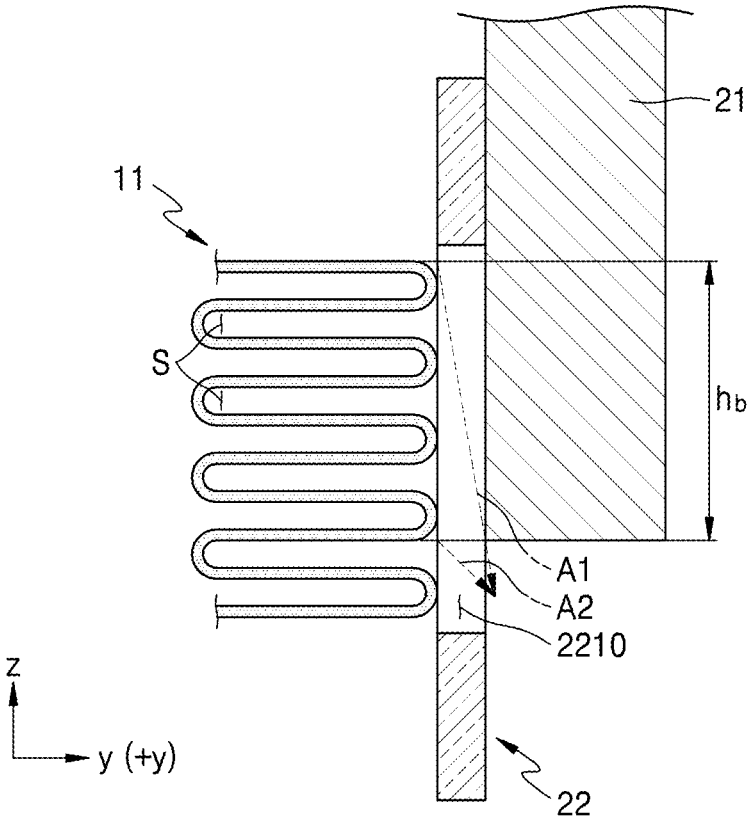
FIG. 7A illustrates a path difference between direct sounds in a state where a portion of a speaker unit is blocked from being exposed to the front direction by a blocking unit, according to an exemplary embodiment, and FIG. 7B conceptually illustrates a portion of FIG. 7A.
Figure 7B:
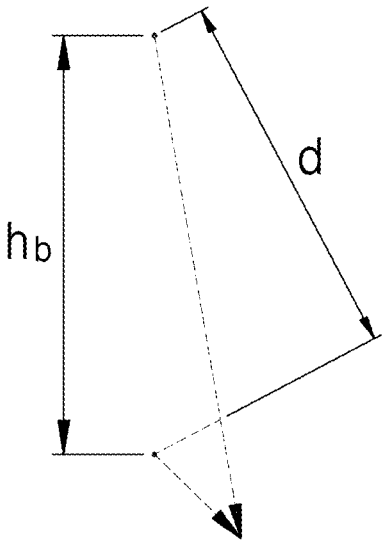

FIG. 7A illustrates a path difference between direct sounds in a state where a portion of the speaker unit 10 is blocked from being exposed to the front direction (+y direction) by the blocking unit 20, according to an exemplary embodiment, and FIG. 7B conceptually illustrates a portion of FIG. 7A.

Referring to FIGS. 7A and 7B, most of a sound reproduced by an upper region of the membrane 11 is reflected by the display unit 21 even though the sound passes through the plurality of release ports 2210. However, a portion A1 of the sound reproduced by the upper region of the membrane 11 may be released through the lower region of the plurality of release ports 2210 of the front grill 22 without being reflected by the display unit 21.

The direct sound A1 radiated from the upper region of the membrane 11 towards the lower region of the front grill 22 may meet a direct sound A2 radiated from a lower region of the membrane 11. In this case, a path difference d occurs between the direct sound A1 radiated from the upper region of the membrane 11 towards the lower region of the front grill 22 and the direct sound A2 radiated from the lower region of the membrane 11. That is, the path difference d occurs between the direct sounds A1 and A2 radiated from the different regions of the membrane 11 in the up-down direction (z direction).

The path difference d between the direct sounds A1 and A2 is less than the blocking height $h_b$ of the membrane 11 blocked by the display unit 21. The blocking height $h_b$ of the membrane 11 blocked by the display unit 21 is less than the half of the minimum wavelength $\lambda_{min}$. Therefore, the path difference d between the direct sounds A1 and A2 radiated from the different regions of the membrane 11 is less than the half of the minimum wavelength $\lambda_{min}$. Accordingly, even though two sounds having the same amplitude and frequency are generated different regions and pass through the same region, the occurrence of offset interference may be prevented or reduced. As a result, even though a region corresponding to a partial height $h_b$ of the membrane 11 is blocked without being exposed to the front direction (+y direction), an acoustic characteristic of the high-frequency range may be prevented from being deteriorated due to interference.

It has been described in the exemplary embodiment described above that the blocking unit 20 includes the front grill 22 and the display unit 21 and the front grill 22 includes the plurality of release ports 2210 extending in the up-down direction (z direction). However, the configuration of the blocking unit 20 and the configuration of the front grill 22 are not limited thereto and may be modified according to design intent.

Figure 8:
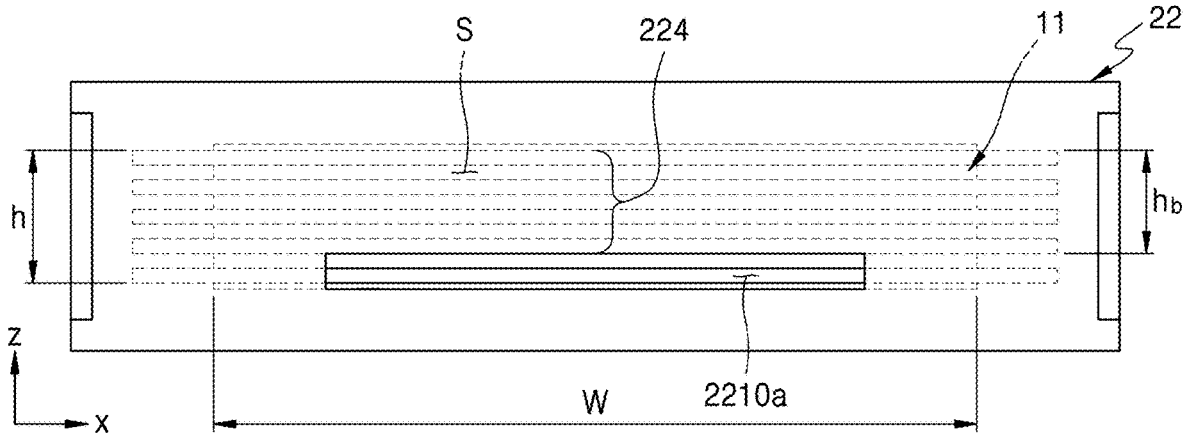
FIG. 8 illustrates a front grill of a speaker apparatus according to an exemplary embodiment.

For example, as shown in FIG. 8, the front grill 22 may include a release port 2210*a* extending in the left-right direction (x direction). The blocking height $h_b$ of the membrane 11, which is blocked by the front grill 22, may be less than the half of the minimum wavelength $\lambda_{min}$ of a sound emitted from the membrane 11. When the front grill 22 includes a ferromagnetic material, because a blocking region 224 of the front grill 22 has no release ports 2210, a relatively strong magnetic field is formed between the blocking region 224 and the magnet 12, and accordingly, a sound pressure level in the upper region of the membrane 11 may be improved. The sound pressure level in the upper region may cause a total sound pressure level of the membrane 11 to be improved.

Figure 9A:
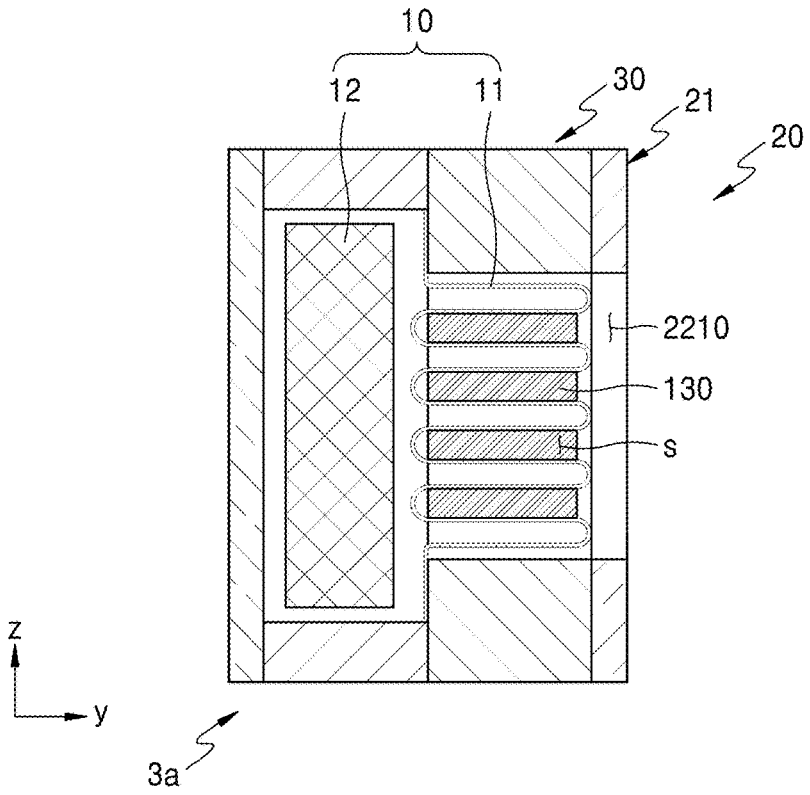
FIG. 9A illustrates a magnified cross-sectional view of a portion of a speaker apparatus according to an exemplary embodiment.
Figure 9B:
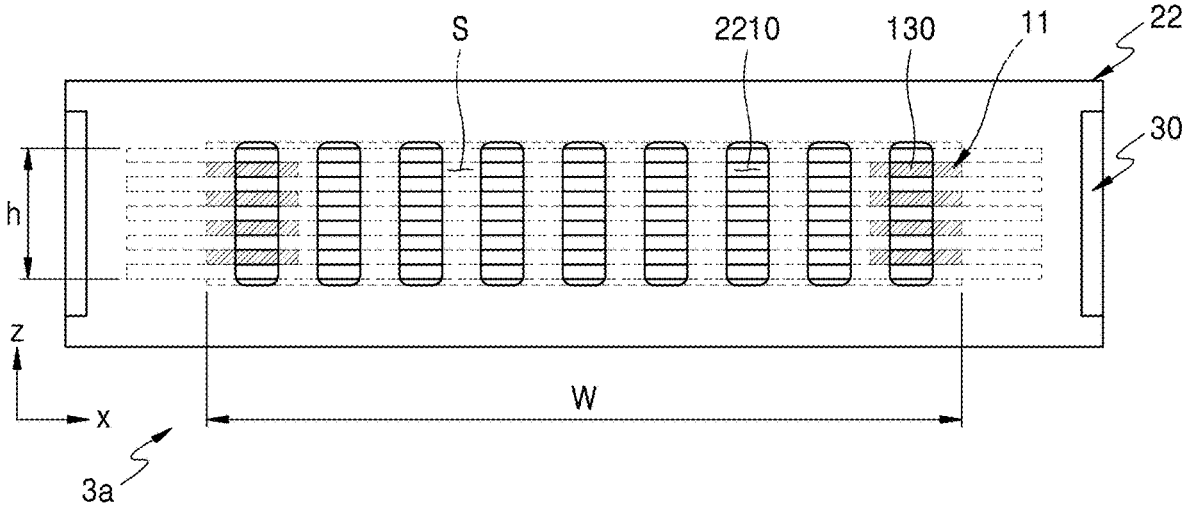
FIG. 9B illustrates a magnified front view of the speaker apparatus of FIG. 9A.
Figure 10:
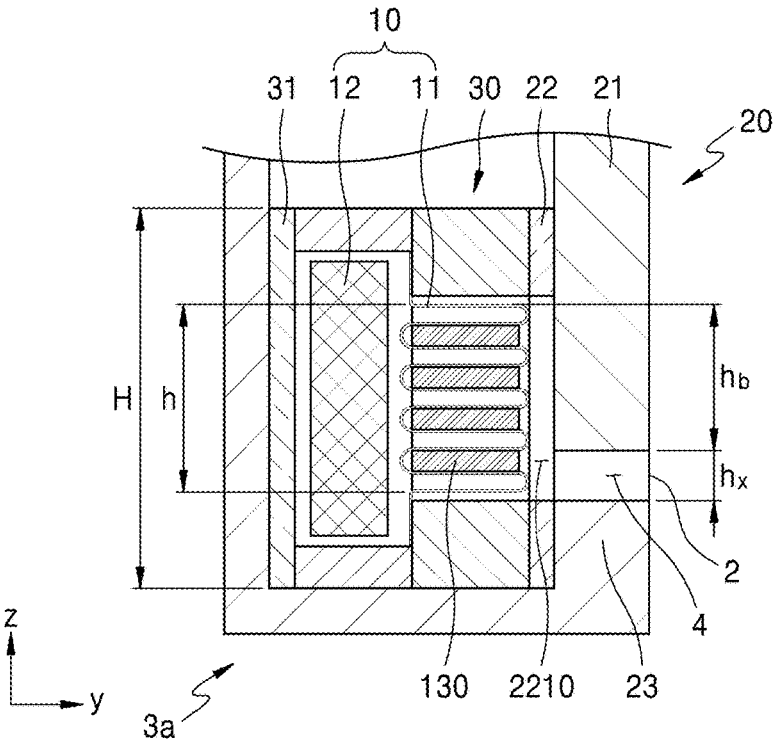
FIG. 10 illustrates a magnified cross-sectional view of an electronic apparatus including the speaker apparatus of FIG. 9A, according to an exemplary embodiment.
Figure 11A:
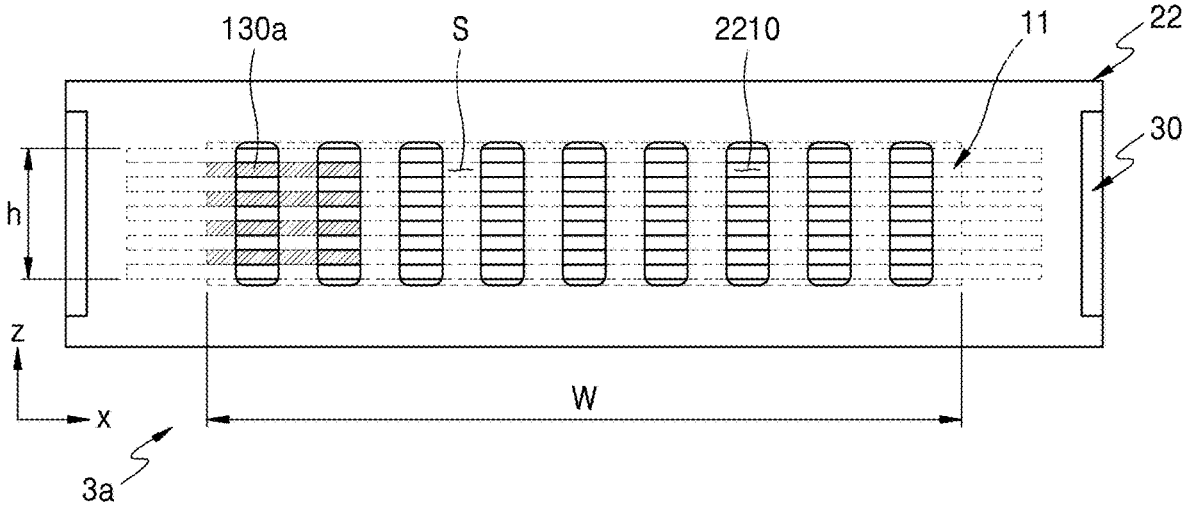
FIGS. 11A through 11C illustrate modified examples of the speaker apparatus of FIG. 9B.
Figure 11B:
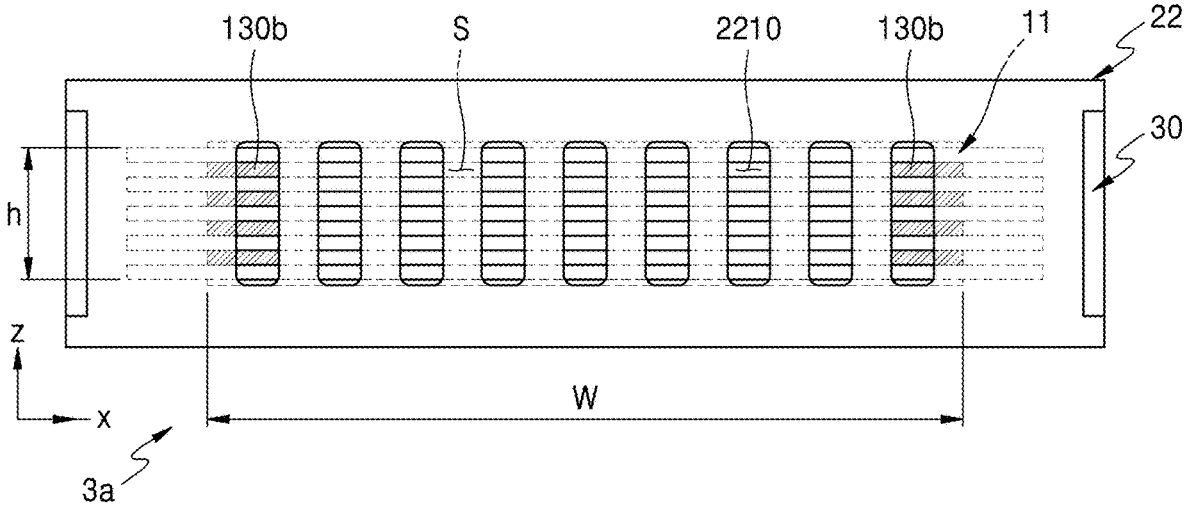
Figure 11C:
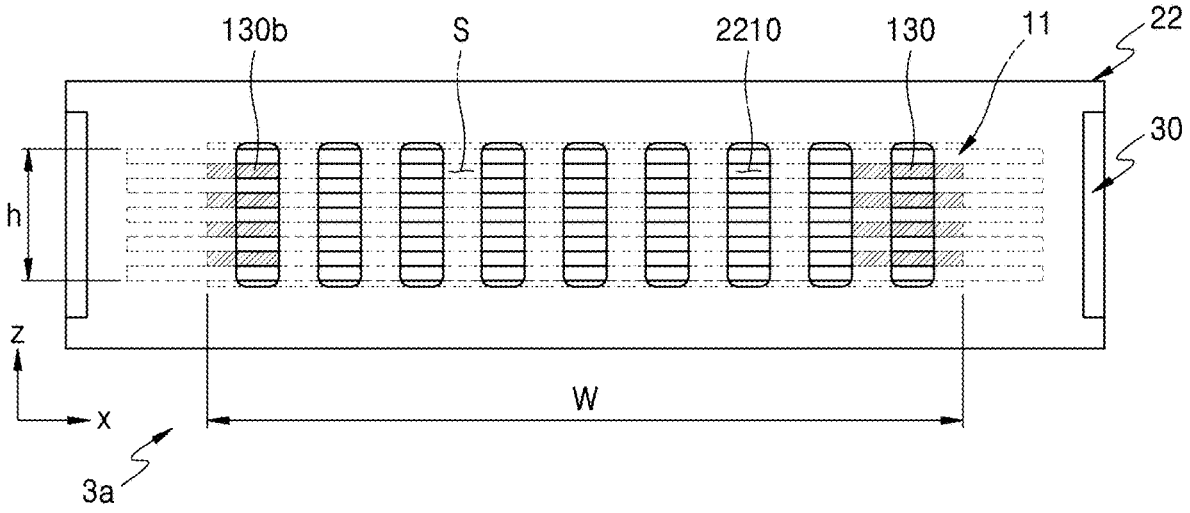

FIG. 9A illustrates a magnified cross-sectional view of a portion of a speaker apparatus 3*a* according to an exemplary embodiment, and FIG. 9B illustrates a magnified front view of the speaker apparatus 3*a* of FIG. 9A. FIG. 10 illustrates a magnified cross-sectional view of the electronic apparatus 1 including the speaker apparatus 3*a* of FIG. 9A, according to an exemplary embodiment. FIGS. 11A through 11C illustrate modified examples of the speaker apparatus 3*a* of FIG. 9B.

Referring to FIGS. 9A and 9B, the speaker apparatus 3*a* according to the exemplary embodiment may include the speaker unit 10, the front grill 22, and a sound-absorption member 130. The description of the same configuration as that of the speaker apparatus 3 according to the exemplary embodiment described above is omitted, and a difference therebetween is mainly described.

The width W of the membrane 11 of the speaker unit 10 may increase by taking into account a requisite sound pressure level. The width W of the membrane 11 may be equal to or greater than about 25 mm and less than about 42 mm.

However, as the width W of the membrane 11 increases, a horizontal coverage characteristic of the speaker apparatus 3*a* may be deteriorated. For example, as the width W of the membrane 11 increases, a horizontal coverage angle may decrease.

The sound-absorption member 130 may be disposed on at least one of opposite end portions of the membrane 11 along the left-right direction (x-direction). For example, the sound-absorption member 130 may be disposed on both the end portions of the membrane 11 as shown in FIG. 9B.

At least a portion of the sound-absorption member 130 may be disposed in the space S defined by the membrane 11. The sound-absorption member 130 may be disposed on both end portions of the space S in the left-right direction (x direction).

The sound-absorption member 130 may absorb a sound generated during vibrations of the membrane 11 and shifted in the left-right direction (x direction) in the space S. Accordingly, a sound being reflected from both the end portions of the space S in the left-right direction (x direction) may be prevented, and the occurrence of a normal wave in the left-right direction (x direction) may be prevented. As a result, distortion occurring in a frequency band having a wavelength corresponding to two times the width W of the membrane 11 may be prevented.

In addition, the sound-absorption member 130 may absorb a portion of a sound emitted from both the end portions of the membrane 11. Accordingly, a sound pressure of a sound emitted from both the end portions of the membrane 11 where the sound-absorption member 130 is disposed may be less than a sound pressure of a sound emitted from a center portion of the membrane 11.

As described above, the sound-absorption member 130 may prevent sound reflection which may occur at both the end portions of the membrane 11 and reduce a sound pressure of a sound emitted from both the end portions of the membrane 11 to prevent deterioration of the horizontal coverage characteristic of the speaker apparatus 3*a*.

The sound-absorption member 130 may be separated or independent from the enclosure 30 supporting the membrane 11. However, the sound-absorption member 130 is not limited thereto. For example, the sound-absorption member 130 may be integrated with the enclosure 30 as one body.

Referring to FIG. 10, the speaker apparatus 3*a* may further include the display unit 21 disposed at the front (+y direction) of the front grill 22. The display unit 21 may act as the blocking unit 20 in the speaker apparatus 3*a*. The blocking height $h_b$ of the membrane 11, which is blocked by the display unit 21, may be less than the half of the minimum wavelength $\lambda_{min}$. The blocking unit 20 including the display unit 21 is the same as described with reference to FIG. 7B, and thus, a description thereof is omitted.

It has been described in the present exemplary embodiment that the sound-absorption members 130 disposed on both the end portions of the membrane 11 have a same length. However, the number, arrangement, and lengths of sound-absorption members 130 may be modified according to design intent. For example, as shown in FIG. 11A, the sound-absorption member 130 may be disposed on one end portion instead of both the end portions. As another example, as shown in FIG. 11B, the lengths of the sound-absorption members 130 disposed on both the end portions of the membrane 11 may be shorter than those in FIG. 9B, or as shown in FIG. 11C, the lengths of the sound-absorption members 130 disposed on both the end portions of the membrane 11 may be different from each other.

Figure 12A:
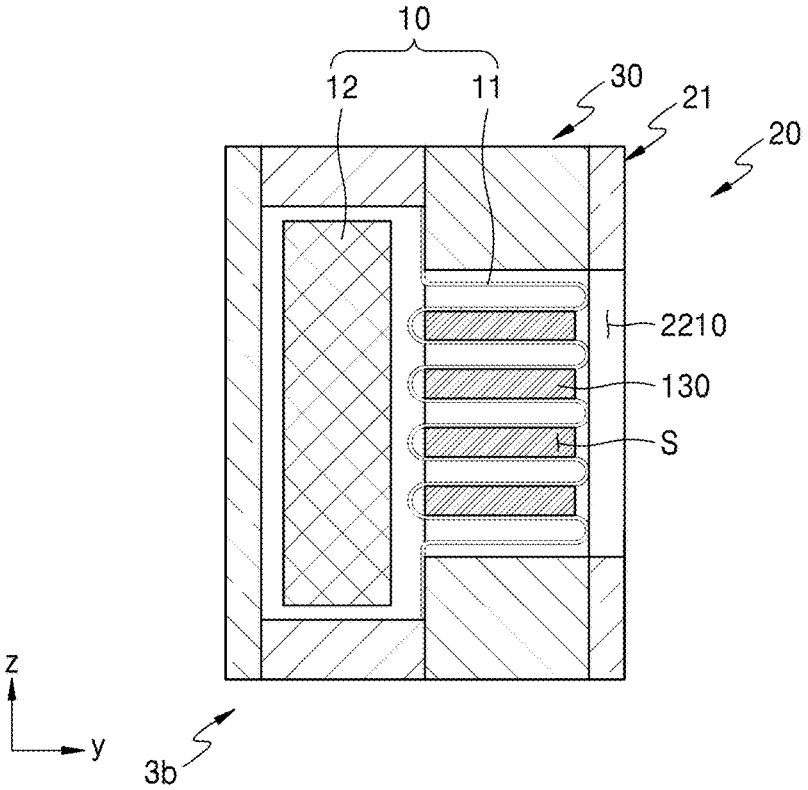
FIG. 12A illustrates a magnified cross-sectional view of a portion of a speaker apparatus according to an exemplary embodiment.
Figure 12B:
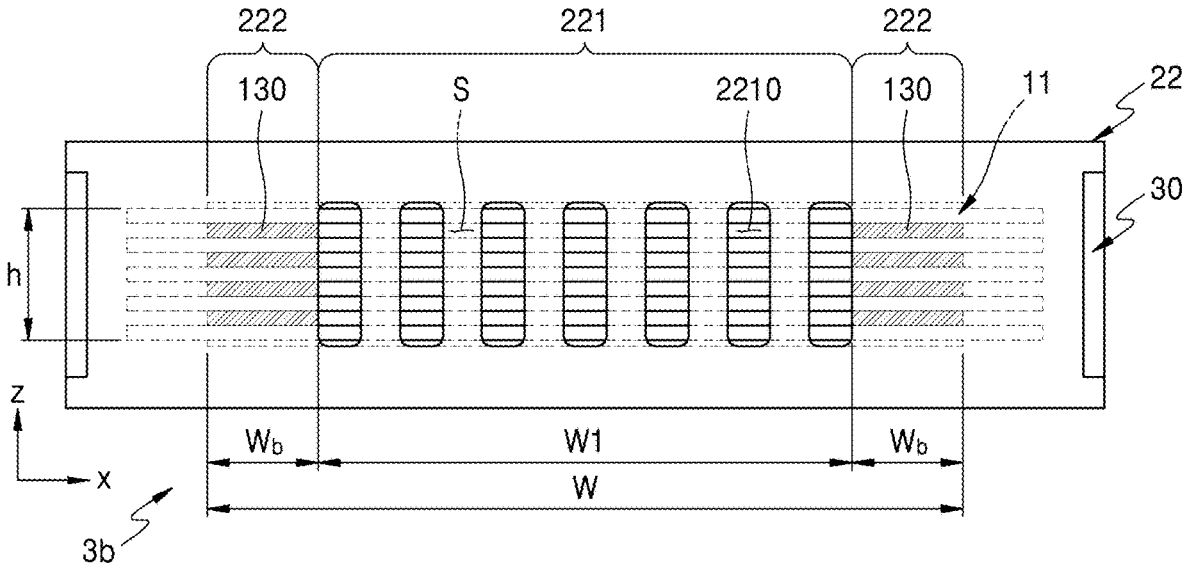
FIG. 12B illustrates a magnified front view of the speaker apparatus of FIG. 12A.
Figure 13:
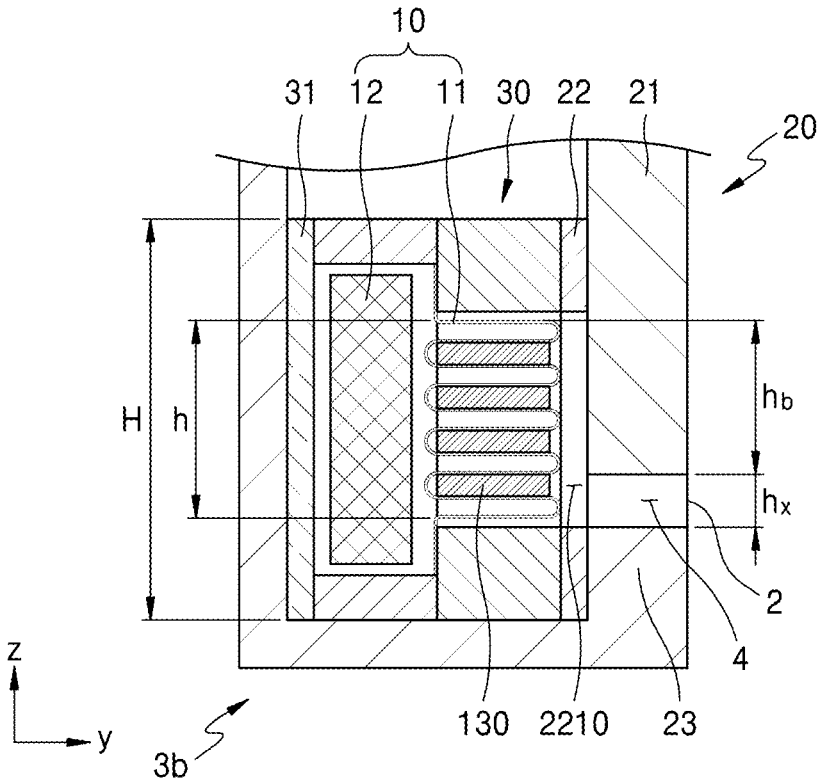
FIG. 13 illustrates a magnified cross-sectional view of an electronic apparatus including the speaker apparatus of FIG. 12A, according to an exemplary embodiment.
Figure 14:
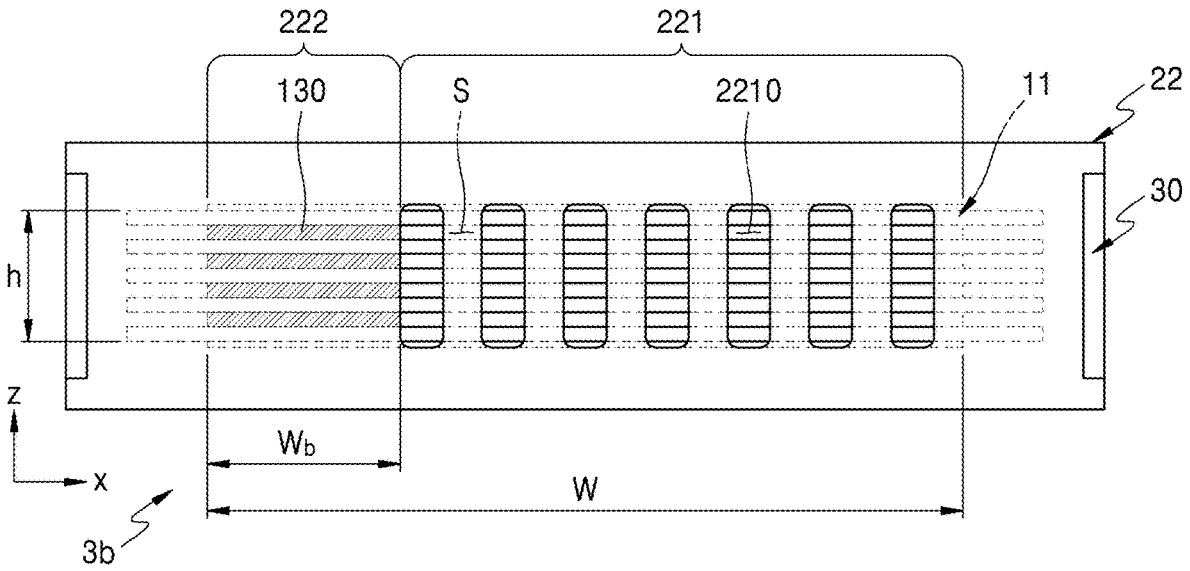
FIGS. 14 and 15 illustrate modified examples of the speaker apparatus of FIG. 12B.
Figure 15:
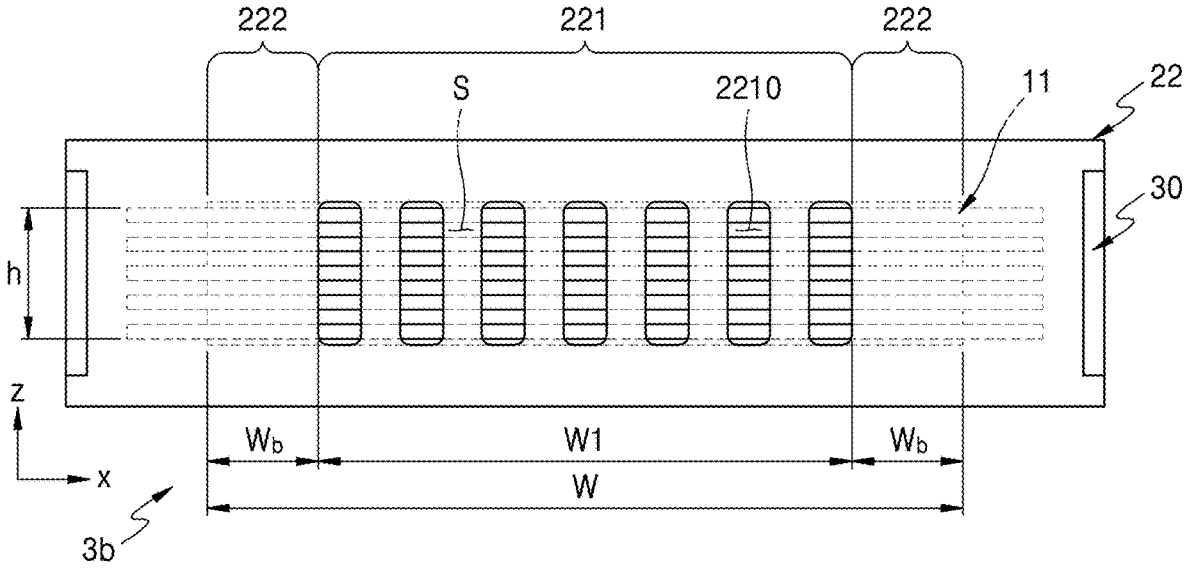

FIG. 12A illustrates a magnified cross-sectional view of a portion of a speaker apparatus 3*b* according to an exemplary embodiment, and FIG. 12B illustrates a magnified front view of the speaker apparatus 3*b* of FIG. 12A. FIG. 13 illustrates a magnified cross-sectional view of the electronic apparatus 1 including the speaker apparatus 3*b* of FIG. 12A, according to an exemplary embodiment. FIGS. 14 and 15 illustrate modified examples of the speaker apparatus 3*b* of FIG. 12B.

Referring to FIGS. 12A and 12B, the speaker apparatus 3*b* according to the exemplary embodiment may include the speaker unit 10, the front grill 22, and the sound-absorption member 130. The description of the same portion as described in the exemplary embodiments described above is omitted, and a difference therebetween is mainly described.

The front grill 22 may be the blocking unit 20, which exposes a portion of the membrane 11 to the front direction (+y direction), or a portion of the blocking unit 20. The front grill 22 includes an open region 221 having the plurality of release ports 2210 through which a sound emitted from the membrane 11 passes in the front direction (+y direction) and a blocking region 222 configured to block the sound emitted from the membrane 11 from passing therethrough in the front direction (+y direction).

The open region 221 may include the plurality of release ports 2210. For example, in the open region 221, the plurality of release ports 2210 extending in the up-down direction (z direction) may be spaced apart from each other in the left-right direction (x direction). However, the shape of the plurality of release ports 2210 is not limited thereto and may be variously modified. For example, although not shown, the plurality of release ports 2210 extending in the left-right direction (x direction) may be spaced apart from each other in the up-down direction (z direction).

A width W1 of the open region 221 may be designed according to a size of a requisite horizontal coverage angle. The width W1 of the open region 221 may be less than the width W of the membrane 11. When the width W1 of the open region 221 is greater than about 25 mm, the width W1 of the open region 221 may be about 25 mm or less. A width of the membrane 11, which is exposed to the front direction (+y direction) by the open region 221, may be about 25 mm or less.

The blocking region 222 is disposed on at least one of both side portions of the open region 221. For example, the blocking region 222 may be disposed on both the side portions of the open region 221.

The membrane 11 may be blocked from being exposed to the front direction (+y direction) by the blocking region 222 of the front grill 22. A partial width $W_b$ of the total width W of the membrane 11 may be blocked from being exposed to the front direction (+y direction) by the blocking region 222.

For example, the blocked width $W_b$ of the membrane 11, which is blocked from being exposed to the front direction (+y direction) by the blocking region 222, may be less than the half of the minimum wavelength $\lambda_{min}$ of a sound emitted from the membrane 11. For example, when the half of the minimum wavelength $\lambda_{min}$ is about 8.5 mm, the blocked width $W_b$ of the membrane 11, which is blocked from being exposed to the front direction (+y direction) by the blocking region 222, may be greater than about 0 mm and less than about 8.5 mm. Each of blocked widths $W_b$ of both the end portions of the membrane 11, which is blocked from being exposed to the front direction (+y direction) by the blocking region 222, may be less than about 8.5 mm. the width W of the membrane 11 may be less than about 42 mm.

By setting the blocked width $W_b$ of the membrane 11, which is blocked from being exposed to the front direction (+y direction) by the blocking region 222, to be less than the half of the minimum wavelength $\lambda_{min}$ of a sound emitted from the membrane 11, distortion of a frequency response characteristic may be reduced even though a region corresponding to the partial width $W_b$ of the membrane 11 is blocked without being exposed to the front direction (+y direction).

The blocking region 222 of the front grill 22 may include a ferromagnetic substance. Since the blocking region 222 has no release ports 2210, a magnetic flux density of a magnetic field provided between the blocking region 222 and the magnet 12 may be greater than a magnetic flux density provided between the open region 221 having the plurality of release ports 2210 and the magnet 12. Accordingly, a total sound pressure level of the membrane may increase.

The sound-absorption member 130 may be disposed on the membrane 11. The sound-absorption member 130 may be disposed in the rear direction of the blocking region 222 of the front grill 22. The sound-absorption member 130 may be disposed in the space S defined by the membrane 11. The sound-absorption member 130 may be disposed on both the end portions in the space S along the left-right direction (x direction).

Referring to FIG. 13, the speaker apparatus 3*b* may further include the display unit 21 disposed in the front direction (+y direction) of the front grill 22. The display unit 21 may act as the blocking unit 20 in the speaker apparatus 3*a* together with the front grill 22. The blocking height $h_b$ of the membrane 11, which is blocked by the display unit 21, may be less than the half of the minimum wavelength $\lambda_{min}$ of a sound emitted from the membrane 11. The blocking unit 20 including the display unit 21 is the same as described with reference to FIG. 7B, and thus, a description thereof is omitted.

It has been described in the exemplary embodiment that the open region 221 of the front grill 22 is formed at a center portion and the sound-absorption member 130 is disposed in the rear direction of the blocking region 222. However, the disposition of the open region 221 of the front grill 22 and inclusion of the sound-absorption member 130 may be selectively modified. For example, as shown in FIG. 14, the open region 221 may be formed to be close to one end portion of the front grill 22, or as shown in FIG. 15, the sound-absorption member 130 may not be disposed in the rear direction of the blocking region 222.

Figure 16:
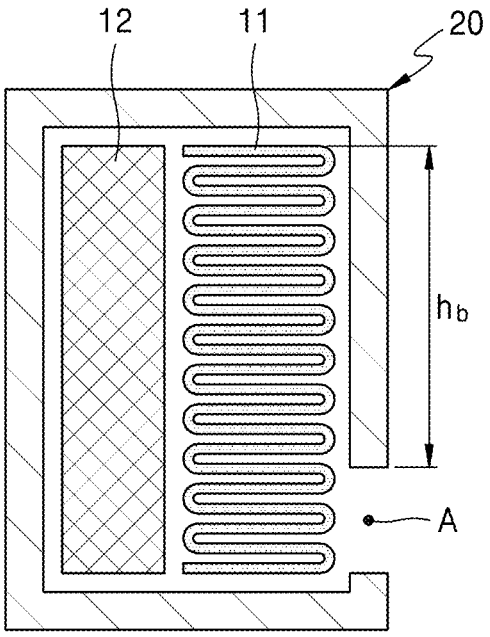
FIGS. 16 and 17 illustrate a change in a sound pressure when a height of a membrane blocked from being exposed by a blocking unit varies.
Figure 17:
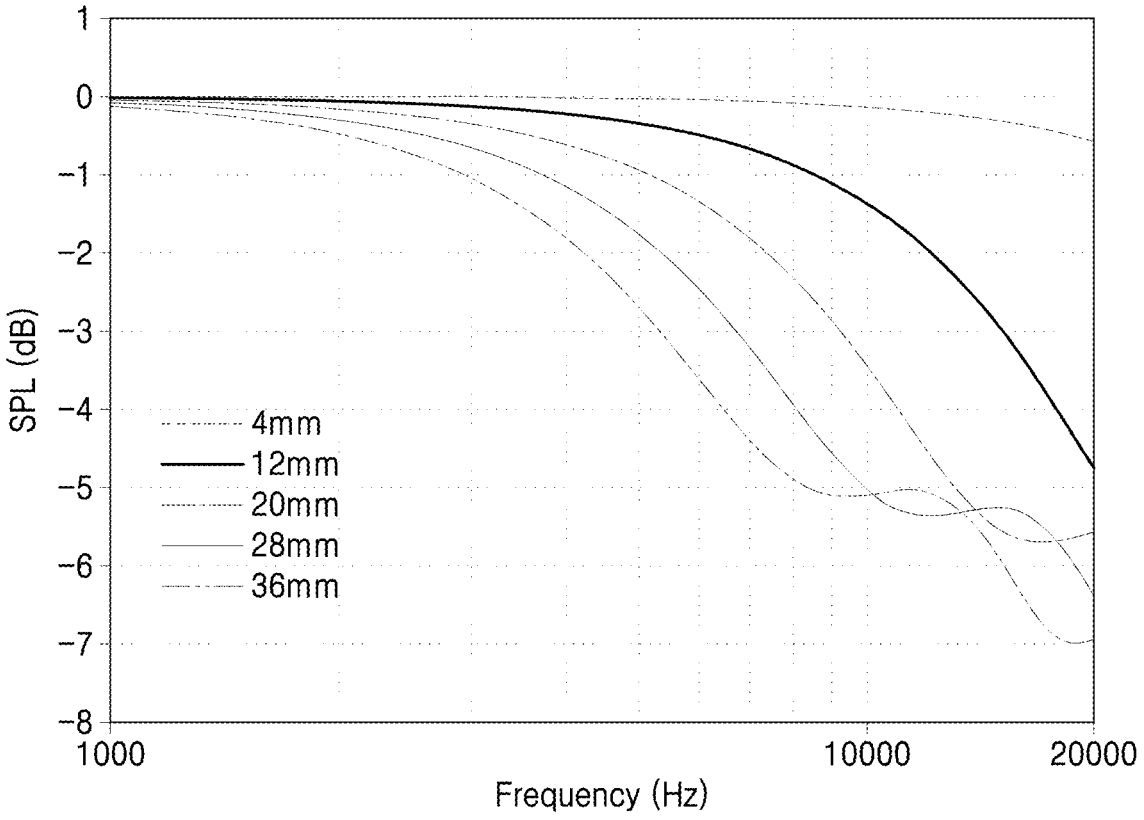

FIGS. 16 and 17 illustrate a change in a sound pressure when the blocking height $h_b$ of the membrane 11 blocked from being exposed by the blocking unit 20 varies.

FIG. 16 illustrates a simulation model showing a state where a portion of the membrane 11 is blocked from being exposed to the front direction (+y direction) by the blocking unit 20. Herein, a frequency range of a sound emitted from the membrane 11 was set to have a maximum frequency of about 20 KHz and a minimum wavelength of about 17 mm.

FIG. 17 shows frequency characteristics by a direct sound at a point A of FIG. 16. FIG. 17 shows a change in a sound pressure when the blocking height $h_b$ according to an exemplary embodiment is 4 mm and changes in a sound pressure when the blocking heights $h_b$ according to comparative examples are respectively 12 mm, 20 mm, 28 mm, and 36 mm.

Referring to FIGS. 16 and 17, because the blocking height $h_b$ according to the present exemplary embodiment is 4 mm, and thus the blocking height $h_b$ according to the present exemplary embodiment is less than 8.5 mm that is the half of the minimum wavelength 17 mm of the sound emitted from the membrane 11. In this case, according to a sound pressure characteristic, a sound pressure was attenuated by about 1 dB or less in a band of about 10 KHz to about 20 KHz.

Because the blocking heights $h_b$ according to the comparative examples are respectively 12 mm, 20 mm, 28 mm, and 36 mm, the blocking heights $h_b$ according to the comparative examples exceed about 8.5 mm that is the half of the minimum wavelength about 17 mm of the sound emitted from the membrane 11. In this case, according to a sound pressure characteristic, as a frequency increases, a sound pressure level rapidly decreased. For example, a sound pressure was attenuated by about 3 dB or more in the band of about 10 KHz to about 20 KHz.

According to the test described above, when the blocking height $h_b$ of the membrane 11 is less than the half of a wavelength corresponding to a maximum frequency of a frequency range of a sound emitted from the membrane 11, attenuation of a sound pressure in the high-frequency range may be prevented.

Figure 18A:
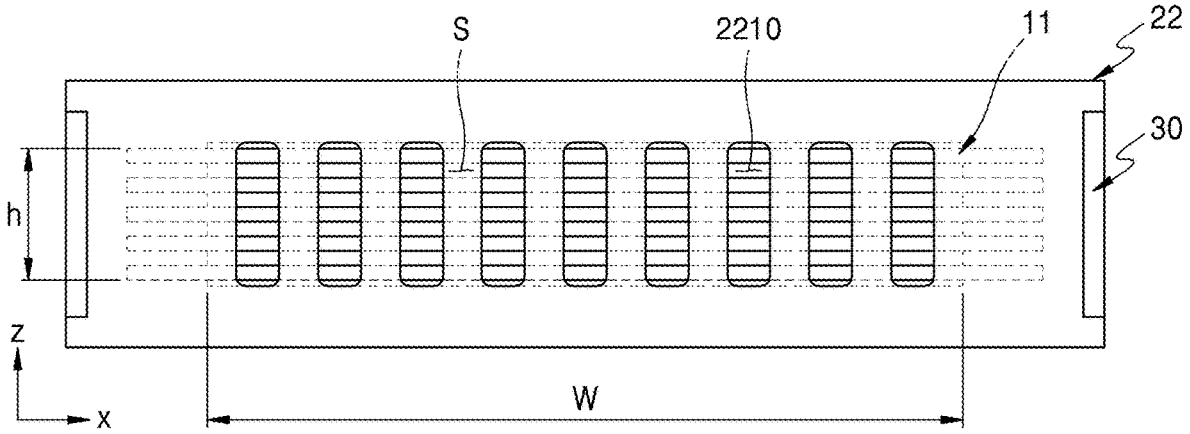
FIGS. 18A through 18C respectively illustrate front views of a speaker apparatus according to exemplary embodiments.
Figure 18B:
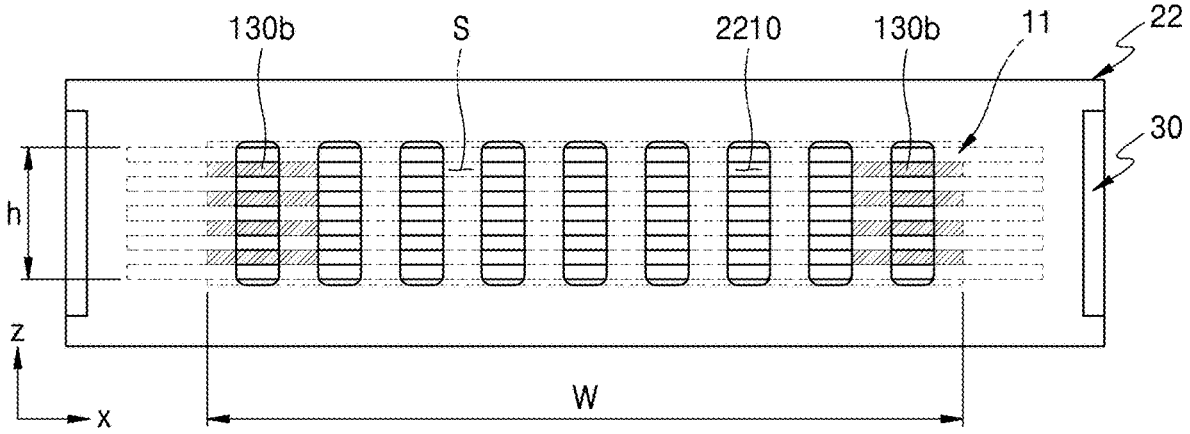
Figure 18C:
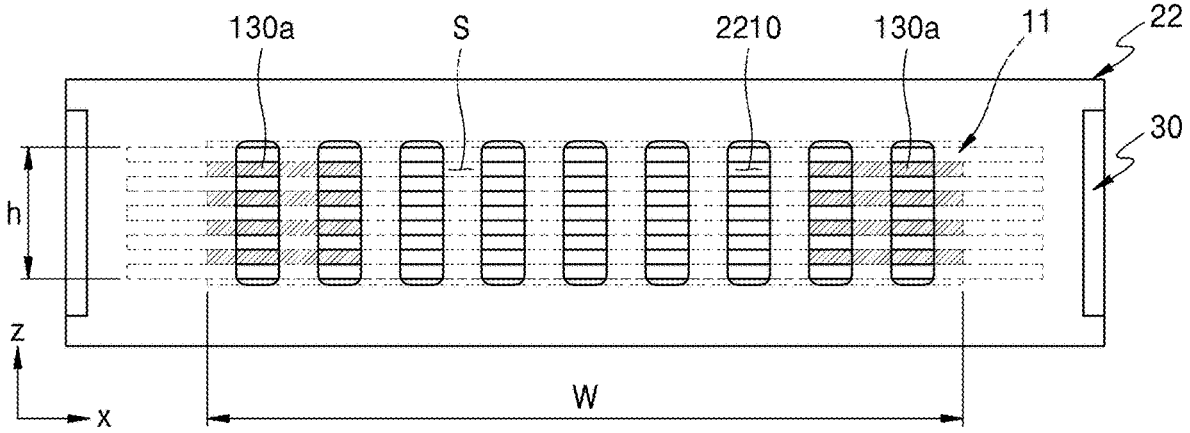
Figure 19:
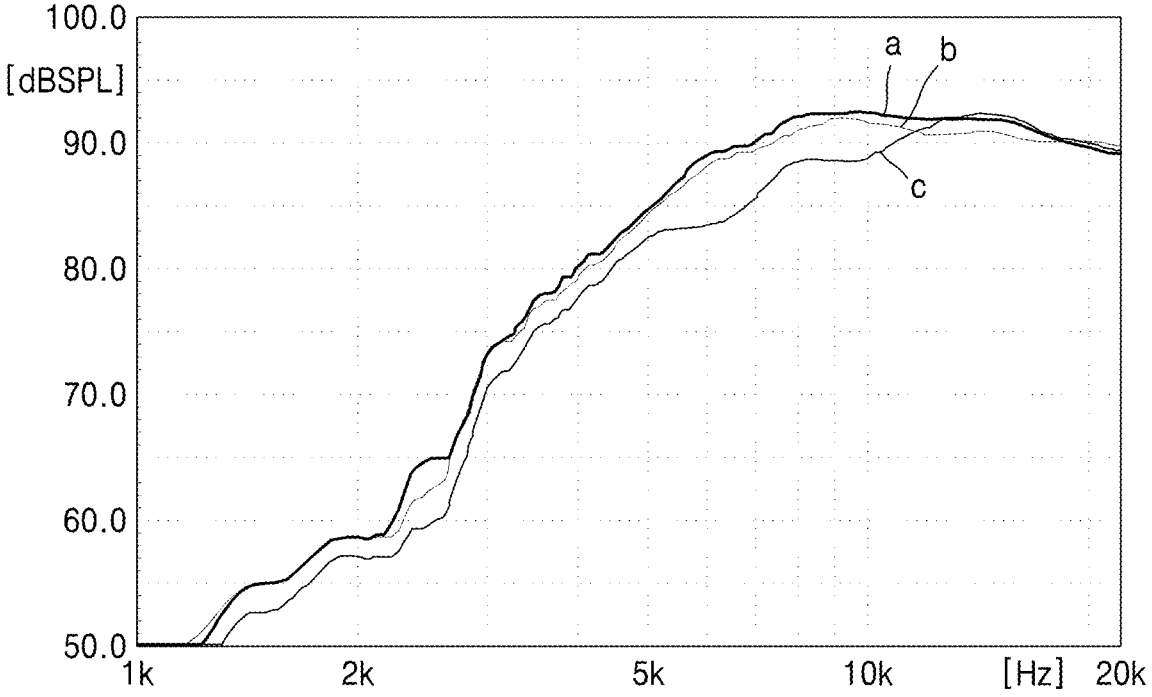
FIG. 19 illustrates graphs showing results of measuring frequency characteristics of sounds emitted from the speaker apparatus according to exemplary embodiments.

FIGS. 18A through 18C respectively illustrate front views of the speaker apparatus 3 according to exemplary embodiments. FIG. 19 illustrates graphs a, b, and c showing results of measuring frequency characteristics of sounds emitted from the speaker apparatus 3 according to the exemplary embodiments, and FIGS. 20A through 20C respectively illustrate test data showing horizontal coverage characteristics of the speaker apparatus 3 according to the exemplary embodiments. In FIG. 19, the graph a shows the frequency characteristic according to the exemplary embodiment of FIG. 18A, the graph b shows the frequency characteristic according to the exemplary embodiment of FIG. 18B, and the graph c shows the frequency characteristic according to the exemplary embodiment of FIG. 18C.

Referring to FIG. 18A, in this exemplary embodiment, the front grill 22 is disposed in the front direction (+y direction) of the membrane 11 meandering in the up-down direction (z direction) and has the plurality of release ports 2210 arranged in the left-right direction (x direction) of the membrane 11. Referring to FIG. 18B, this exemplary embodiment is almost the same as the exemplary embodiment of FIG. 18A except that a sound-absorption member 130*b* having a width of about 4 mm is disposed on both end portions of the membrane 11 in the left-right direction (x direction). Referring to FIG. 18C, the exemplary embodiment is almost the same as the exemplary embodiment of FIG. 18B except that a width of each of sound-absorption members 130*a* disposed on both the end portions of the membrane 11 is about 8 mm.

Referring to the graphs a, b, and c in FIG. 19, a phenomenon that a sound pressure suddenly decreases in the high-frequency range did not appear from the sounds respectively emitted from the speaker apparatus 3 according to the exemplary embodiments of FIGS. 18A-18C. That is, the speaker apparatus 3 according to the exemplary embodiments exhibited a good sound pressure characteristic even in the high-frequency range.

Figure 20A:
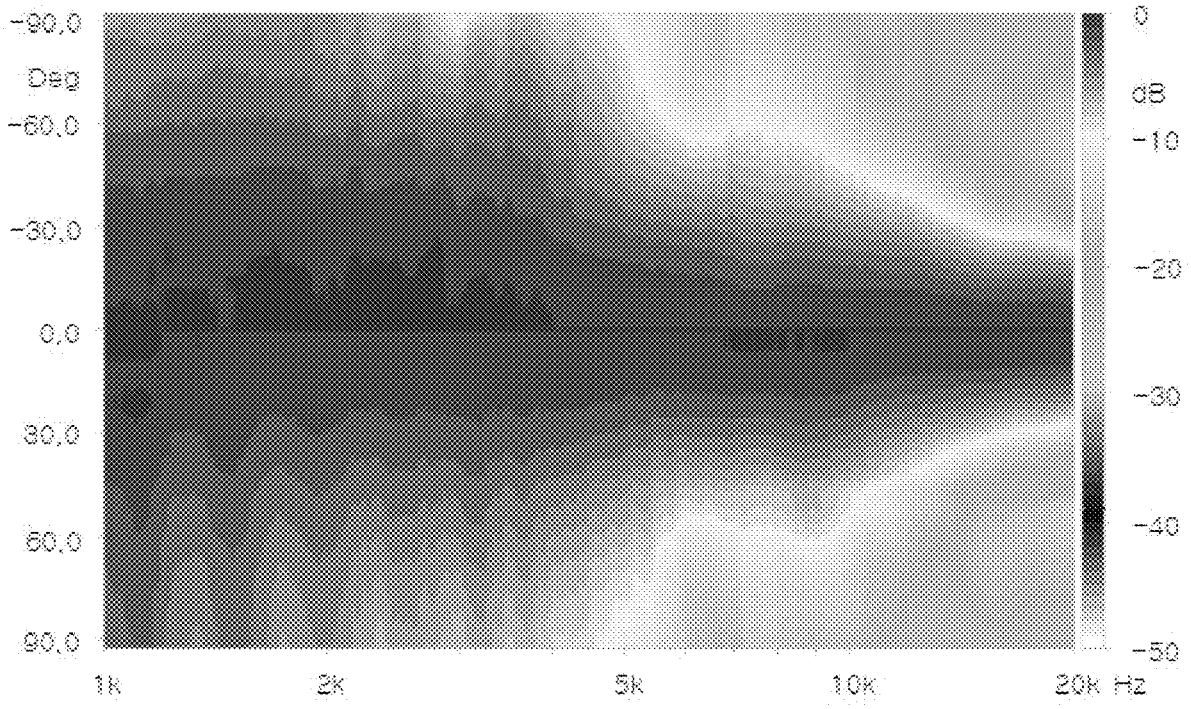
FIGS. 20A through 20C respectively illustrate test data showing horizontal coverage characteristics of the speaker apparatus according to exemplary embodiments.
Figure 20B:
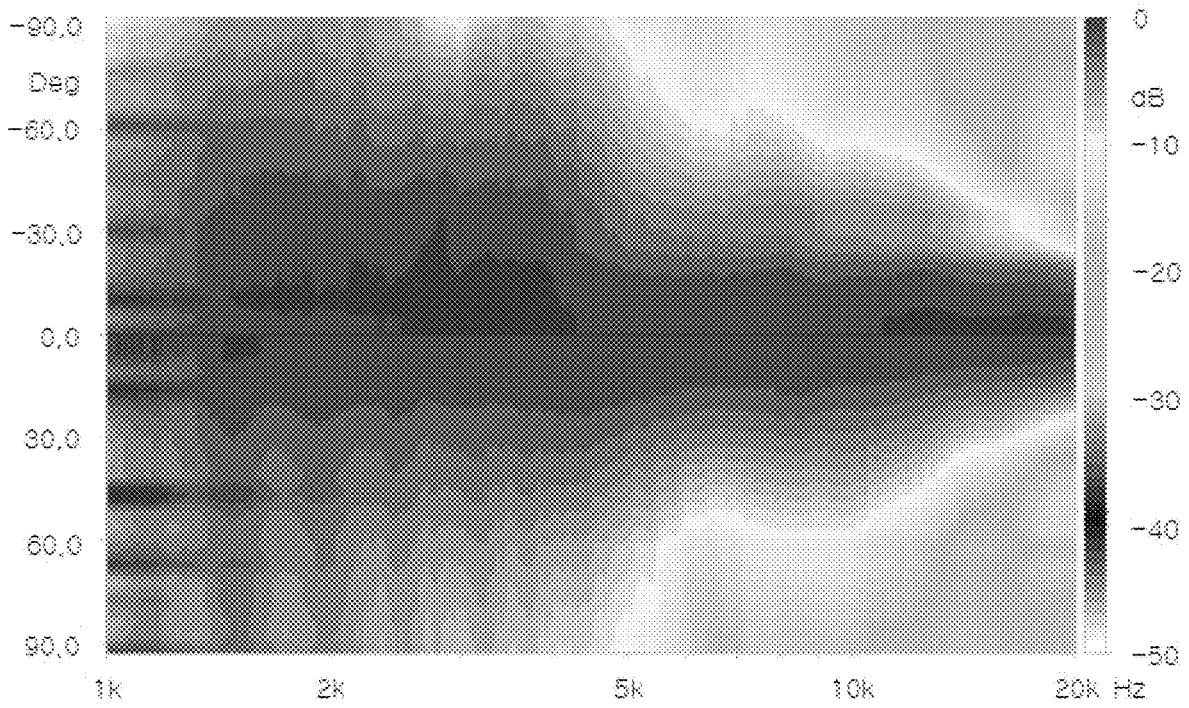
Figure 20C:
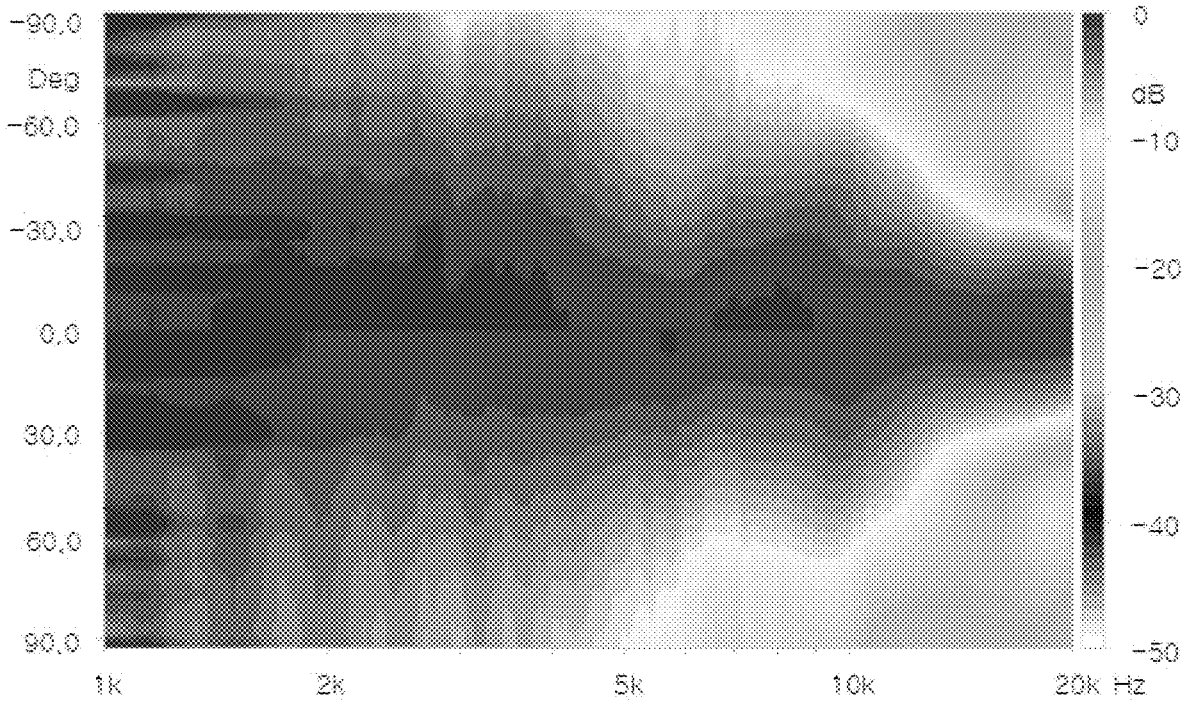

Referring to FIGS. 20A through 20C, compared with the speaker apparatus 3 according to the exemplary embodiment of FIG. 18A, a horizontal coverage angle of the speaker apparatus 3 according to the exemplary embodiment of FIG. 18B in which the sound-absorption members 130*b* are disposed on both the end portions of the membrane 11 was wider. In addition, compared with the speaker apparatus 3 according to the exemplary embodiment of FIG. 18B in which the width of the sound-absorption member 130*b* is relatively narrow, a horizontal coverage angle of the speaker apparatus 3 according to the exemplary embodiment of 18C in which the width of the sound-absorption member 130*a* is relatively wide was wider.

As described above, when the sound-absorption member 130*a* or 130*b* is disposed on the membrane 11 meandering/winding in the up-down direction (z direction), a horizontal coverage angle of the speaker apparatus 3 may be improved.

Figure 21A:
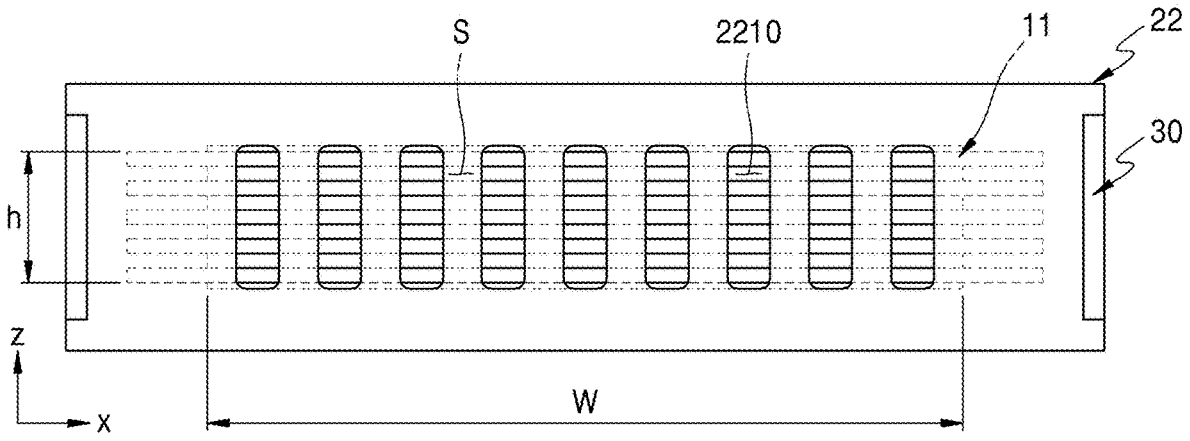
FIGS. 21A through 21C respectively illustrate front views of a speaker apparatus according to exemplary embodiments.
Figure 21B:
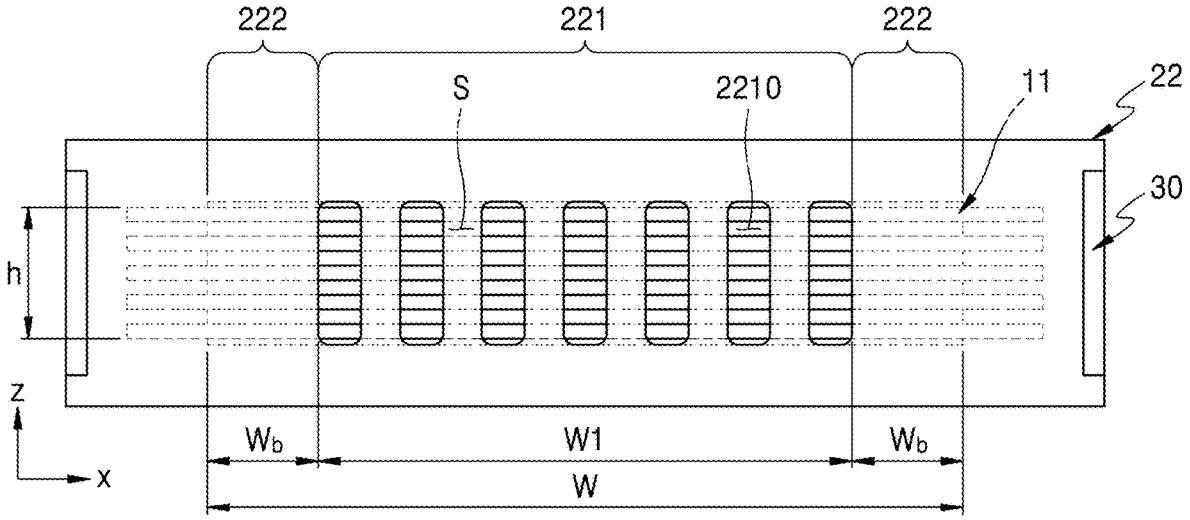
Figure 21C:
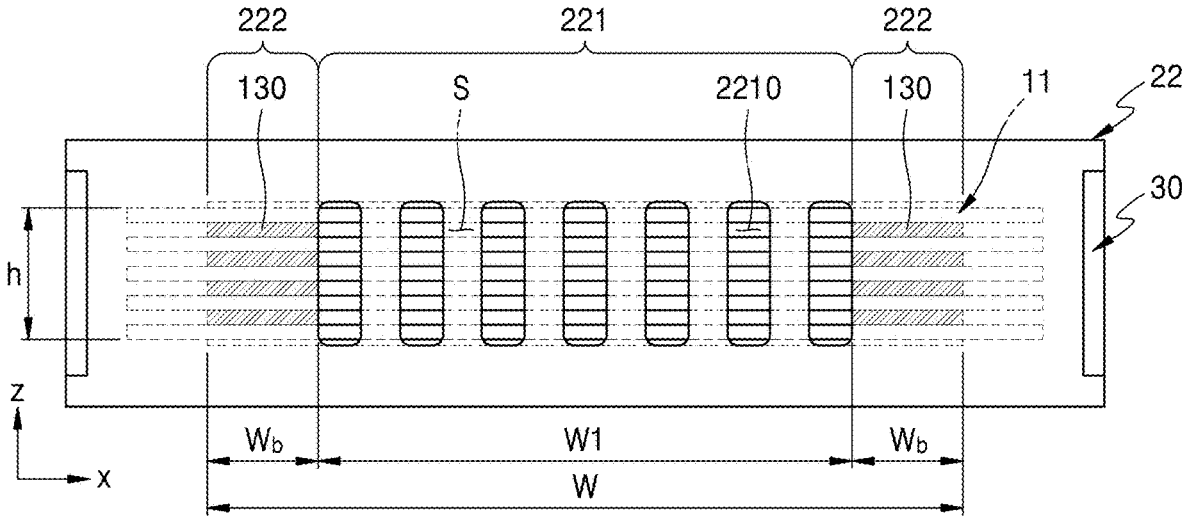
Figure 22A:
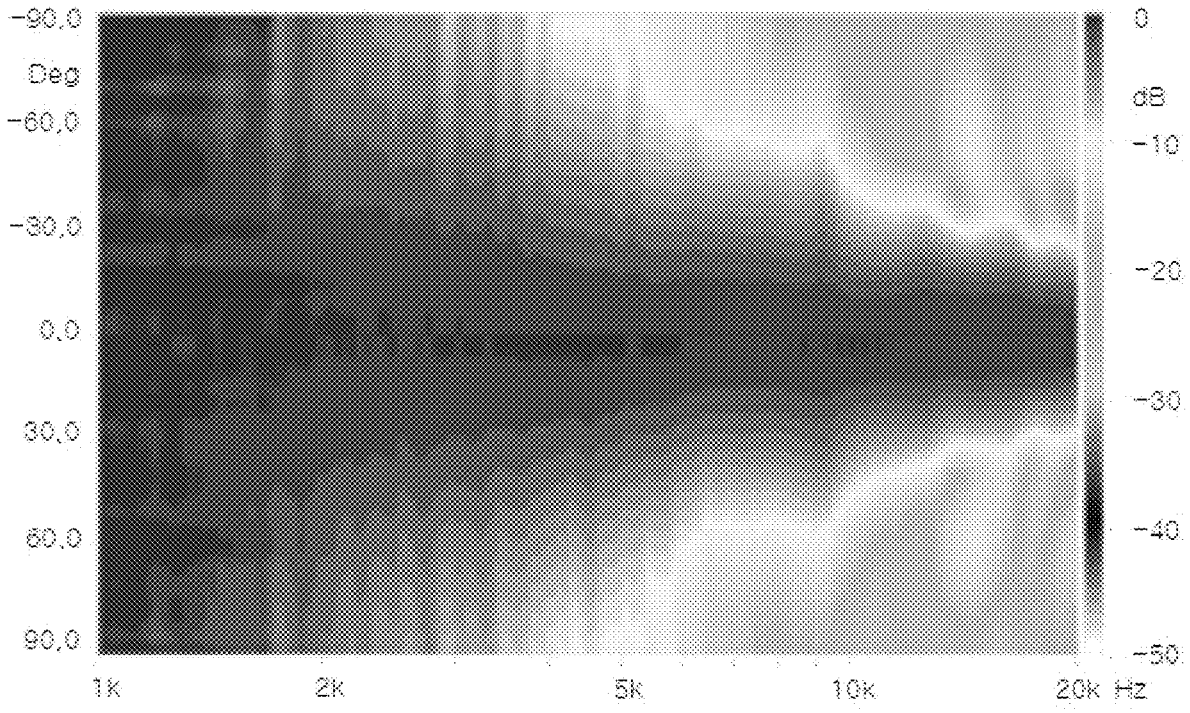
FIGS. 22A through 22C respectively illustrate test data showing horizontal coverage characteristics of the speaker apparatus of FIGS. 21A through 21C, according to t exemplary embodiments.
Figure 22B:
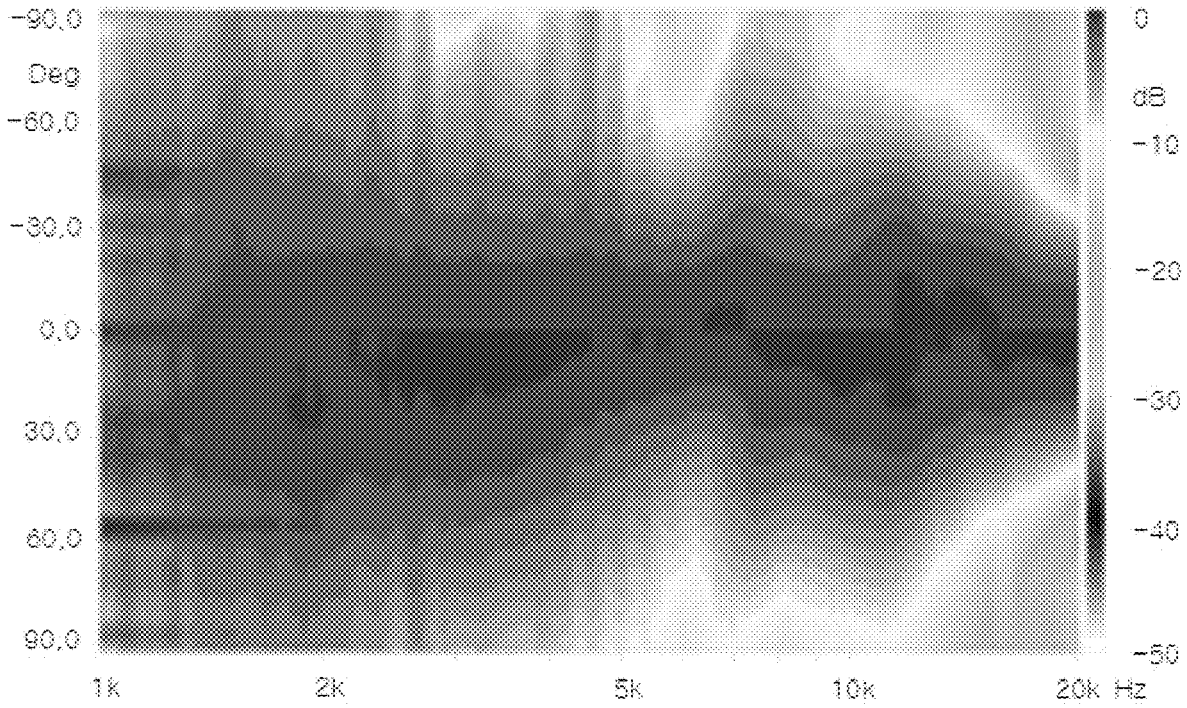
Figure 22C:
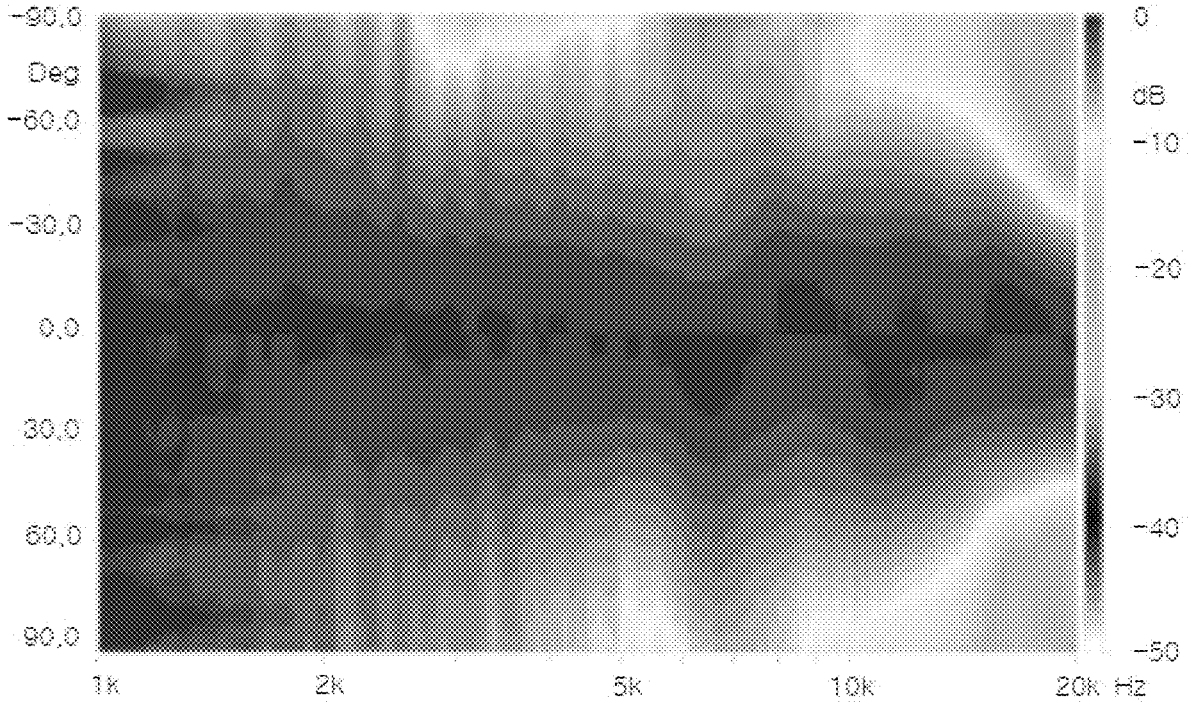

FIGS. 21A through 21C respectively illustrate front views of the speaker apparatus 3 according to exemplary embodiments. FIGS. 22A through 22C respectively illustrate test data showing horizontal coverage characteristics of the speaker apparatus 3 of FIGS. 21A through 21C, according to the exemplary embodiments.

Referring to FIG. 21A, in this exemplary embodiment, the front grill 22 is disposed at the front (+y direction) of the membrane 11 meandering/winding in the up-down direction (z direction) and has the plurality of release ports 2210 arranged in the left-right direction (x direction) of the membrane 11. Referring to FIG. 21B, this exemplary embodiment is almost the same as the exemplary embodiment of FIG. 21A except that a width of the open region 221 of the front grill, in which the plurality of release ports 2210 are formed, is narrower than a width of the membrane 11 and each of both the end portions of the membrane 11 in the left-right direction (x direction) is blocked by a width of about 8 mm from being exposed to the front direction (+y direction) by the blocking region 222 of the front grill 22. Referring to FIG. 21C, this exemplary embodiment is almost the same as the exemplary embodiment of FIG. 21B except that the sound-absorption member 130 of which a width is about 8 mm is disposed on both the end portions of the membrane 11, which are blocked by the blocking region 222.

Referring to FIGS. 22A through 22C, compared with the speaker apparatus 3 according to the exemplary embodiment of FIG. 21A, a horizontal coverage angle of the speaker apparatus 3 according to the exemplary embodiment of FIG. 21B in which the width of the open region 221 of the front grill is narrower than the width of the membrane 11 was wider. In addition, compared with the speaker apparatus 3 according to the exemplary embodiment of FIG. 21B in which the sound-absorption member 130 is not disposed, a horizontal coverage angle of the speaker apparatus 3 according to the exemplary embodiment of FIG. 21C in which the sound-absorption member 130 is disposed was wider.

As described above, when both the end portions of the membrane 11 meandering/winding in the up-down direction (z direction) are blocked from being exposed to the front direction (+y direction) by the front grill 22, and the sound-absorption member 130 is disposed on the portions of the membrane 11 blocked from being exposed, a horizontal coverage angle of the speaker apparatus 3 may be improved.

It has been described in the exemplary embodiments described above that the speaker apparatuses 3, 3*a*, and 3*b* including the speaker unit 10 configured to output a sound of the high-frequency range. However, the exemplary embodiments are not limited thereto and may be applied to structures in which a sound is output through a slit smaller than a size of the speaker unit 10. For example, the speaker apparatus 3, 3*a*, or 3*b* may include a full-range speaker unit capable of outputting a full-range sound wave.

A speaker apparatus according to one or more exemplary embodiments and an electronic apparatus including the same may exhibit a wide horizontal directivity while outputting a sound of the high-frequency range which has a sound pressure of a certain level or more.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While exemplary embodiments have been particularly shown and described above, it will be understood by those of ordinary skill in the art that various changes in form and details may be made therein without departing from the spirit and scope of the inventive concept as defined by the following claims.

What is claimed is:

1. A speaker apparatus comprising:

a speaker unit comprising:

a magnet configured to provide a magnetic field; and a membrane disposed in the magnetic field, configured to be expanded and compressed in a first direction, and configured to emit a sound in a second direction perpendicular to the first direction; and a blocking unit disposed at the membrane, configured to block a first region of the membrane having a first height in the first direction from being exposed and configured to expose a second region of the membrane having a second height in the first direction, a sum of the first and the second heights in the first direction corresponds to a total height of the membrane in the first direction, wherein a width of the membrane extending in a third direction, which is perpendicular to the first and the second directions, is greater than the total height of the membrane in the first direction, wherein a path difference between direct sounds radiated from different positions along the first direction in the first region is less than a half of a wavelength corresponding to a maximum frequency in a frequency range of the sound emitted from the membrane, and wherein the frequency range of the sound is a high-frequency range.

2. The speaker apparatus of claim 1, wherein the membrane has a meandering shape along the first direction and vibrates while adjacent facing regions of the membrane facing each other move in opposite directions of each other along the first direction.

3. The speaker apparatus of claim 1, wherein the frequency range of the sound emitted from the membrane satisfies a sound pressure level that is equal to or greater than a sound pressure level lower by 6 dB than an average sound pressure level of the sound emitted from the membrane.

4. The speaker apparatus of claim 1, wherein the maximum frequency is about 20 KHz, and wherein the half of the wavelength corresponding to the maximum frequency of 20 KHz is about 8.5 mm.

5. The speaker apparatus of claim 1, wherein the second height of the membrane is about 5 mm or less.

6. The speaker apparatus of claim 1, wherein the total height of the membrane is less than about 13.5 mm.

7. The speaker apparatus of claim 1, further comprising an enclosure configured to accommodate the speaker unit, wherein a height of the enclosure in the first direction is less than about 16.5 mm.

8. The speaker apparatus of claim 1, wherein the width of the membrane in the third direction is less than about 42 mm.

9. The speaker apparatus of claim 1, further comprising a sound-absorption member provided on at least one of opposite end portions of the membrane along the third direction.

10. The speaker apparatus of claim 9, wherein the membrane comprises:

adjacent facing regions facing each other along the first direction; and a connection region disposed between the adjacent facing regions to connect the adjacent facing regions, wherein the connection region comprises a ridge region disposed on a first side of the membrane along the second direction and a valley region disposed on a second side opposite to the first side of the membrane along the second direction, and wherein the sound-absorption member is disposed in a space defined by the adjacent facing regions and the valley region.

11. The speaker apparatus of claim 1, wherein the blocking unit is configured to expose a third region having a first width of the membrane in the third direction perpendicular to the first and the second directions and configured to block a fourth region having a second width of the membrane from being exposed, a sum of the first and the second widths correspond to a total width of the membrane.

12. The speaker apparatus of claim 11, wherein the first width of the membrane is about 25 mm or less.

13. The speaker apparatus of claim 11, wherein the second width of the membrane being blocked by the blocking unit is less than the half of the wavelength corresponding to the maximum frequency of the sound emitted from the membrane.

14. The speaker apparatus of claim 13, further comprising a sound-absorption member disposed at the fourth region in which the membrane is blocked from being exposed by the blocking unit.

15. The speaker apparatus of claim 1, wherein the blocking unit comprises:

a front grill disposed at the membrane; and a display unit disposed at the front grill.

16. The speaker apparatus of claim 15, wherein the first region of the membrane having the first height is blocked from being exposed by at least one of the display unit and the front grill.

17. The speaker apparatus of claim 11, wherein the blocking unit comprises a front grill disposed at the membrane and a display unit disposed at the front grill, the fourth region of the membrane having the second width is blocked from being exposed by at least one of the display unit and the front grill.

18. An electronic apparatus comprising the speaker apparatus of claim 1.

19. The speaker apparatus of claim 1, wherein the blocking unit extends parallel to the first direction.

20. A speaker apparatus comprising:

a speaker unit comprising:

a magnet configured to provide a magnetic field; and a membrane disposed in the magnetic field, configured to be vibratable in a vertical direction and configured to emit a sound in a first horizontal direction perpendicular to the vertical direction, the membrane having a total width in a second horizontal direction which is greater than a height in the vertical direction, the second horizontal direction being perpendicular to the first horizontal direction and the vertical direction; and a sound-absorption member disposed on at least one of opposite end portions of the membrane in the second horizontal direction and contacting the membrane to absorb a portion of the sound emitted from the membrane, the membrane comprises:

adjacent facing regions facing each other in the vertical direction; and a connection region disposed between the adjacent facing regions to connect the adjacent facing regions, wherein the connection region comprises:

a ridge region disposed on a first side of the membrane in the first horizontal direction; and a valley region disposed on a second side opposite to the first side of the membrane in the first horizontal direction, and wherein the sound-absorption member is disposed in at least one of opposite end portions of a space defined by the adjacent facing regions and the valley region.

21. The speaker apparatus of claim 20, further comprising a blocking unit disposed at the membrane, configured to expose a first region of the membrane having a first width in the second horizontal direction and configured to block a second region having a second width in the second horizontal direction from being exposed in the first horizontal direction, a sum of the first and the second widths corresponding to the total width in the second horizontal direction, and wherein the second width of the membrane is less than a half of a wavelength corresponding to a maximum frequency in a frequency range of the sound emitted from the membrane.

22. The speaker apparatus of claim 21, wherein the blocking unit extends parallel to the vertical direction.

23. A speaker apparatus comprising:

a speaker unit comprising:

a magnet configured to provide a magnetic field; and a membrane disposed in the magnetic field, configured to be expanded and compressed in a first direction, and configured to emit a sound in a second direction perpendicular to the first direction by being expanded and compressed; and a blocking unit disposed at a first side of the membrane along the second direction and comprising:

a first portion configured to block a first region of the membrane provided on the first side of the membrane and having a first height in the first direction; and a second portion configured to expose a second region of the membrane provided on the first side of the membrane and having a second height in the first direction, wherein a sum of the first and the second heights of the membrane corresponds to a total height of the membrane in the first direction, wherein a path difference between direct sounds radiated from different positions along the first direction in the first region is less than a half of a wavelength corresponding to a maximum frequency in a frequency range of the sound emitted from the membrane, and wherein the frequency range of the sound is a high-frequency range.

24. The speaker apparatus of claim 23, wherein a width of the membrane extending in a third direction, which is perpendicular to the first and the second directions, is greater than the total height of the membrane in the first direction.

25. The speaker apparatus of claim 23, wherein the second portion comprises an acoustic guide tube.

26. The speaker apparatus of claim 23, wherein the blocking unit extends parallel to the first direction.

* * * * *